US006955209B2

(12) United States Patent
Allor et al.

(10) Patent No.: US 6,955,209 B2
(45) Date of Patent: Oct. 18, 2005

(54) METHOD AND ARRANGEMENT IMPLEMENTING HEAT TREATMENT AFTER THE EXECUTION OF SPRAYFORM TECHNIQUES

(75) Inventors: Richard L Allor, Livonia, MI (US); Allen Dennis Roche, Saline, MI (US); Samir Samir, Saline, MI (US)

(73) Assignee: Ford Motor Company, Dearborn, MI (US)

( * ) Notice: Subject to any disclaimer, the term of this patent is extended or adjusted under 35 U.S.C. 154(b) by 511 days.

(21) Appl. No.: 09/683,157

(22) Filed: Nov. 27, 2001

(65) Prior Publication Data

US 2003/0098138 A1 May 29, 2003

Related U.S. Application Data

(60) Provisional application No. 60/338,825, filed on Nov. 5, 2001.

(51) Int. Cl.[7] ..... B22D 23/00

(52) U.S. Cl. ..... 164/46; 164/122; 148/540; 148/559

(58) Field of Search ..... 164/46, 121, 122, 164/271, 272; 148/540, 559

(56) References Cited

U.S. PATENT DOCUMENTS

| | | | | |
|---|---|---|---|---|
| 4,481,237 A | | 11/1984 | Bosshart et al. | 427/376.4 |
| 5,424,101 A | | 6/1995 | Atkins et al. | 427/448 |
| 5,430,376 A | | 7/1995 | Viertl | 324/227 |
| 5,658,506 A | | 8/1997 | White et al. | 264/28 |
| 5,947,179 A | * | 9/1999 | Kinane et al. | 164/45 |
| 5,952,056 A | * | 9/1999 | Jordan et al. | 164/46 |

OTHER PUBLICATIONS

K–H Busse; Arc Spraying Of Corded Wires; Thermal Spraying; Jun. 1989; 19–28.

Steeper et al.; A Taguchi Experimental Design Study Of Twin–Wire Electric Arc Sprayed Aluminum Coatings; Proceedings of the International Thermal Spray Conference & Exposition; May 28–Jun. 5, 1992; 427–432; Orlando, FL.

Akira Ohmori; Thermal Spraying Current Status And Future Trends; Proceedings of the 14$^{th}$ International Thermal Spray Conference; May 22–26, 1995; 1197–1202; Kobe, Japan.

Crane et al.; Relationships Between Process Variables, Structure And Mechanical Properties of Arc Sprayed Steel Coatings; Surface Engineering Conference; 1985; 103–118.

Newbery et al.; The Electric Arc Spray Manufacture of Rapid Production Tooling: A Case Study; Proceedings of the 15$^{th}$ International Thermal Spray Conference; May 25–29, 1998; 1223–1228; Nice, France.

Zurecki et al.; Electric Arc Deposition of Carbon Steel Coatings with Imporved Mechanical Properties; Journal of Thermal Spray Technology; Dec. 1997; vol. 6(4); 417–421.

Harris et al.; Influence of Heat Transfer on the Structure and Properties of Arc Sprayed Low Alloy Steels; Surface Engineering conference; 1985; 78–94.

(Continued)

*Primary Examiner*—Kiley Stoner
*Assistant Examiner*—I.-H. Lin
(74) *Attorney, Agent, or Firm*—Brooks Kushman P.C.; Damian Porcari

(57) ABSTRACT

A method and arrangement for implementing post-heat treatment after spray forming is ended to achieve stress control in the manufacture of a spray formed metallic tool involves providing a spray-formed metallic tool by applying a spray-forming material on a mold substrate and causing substantially homogenous metallic phase transformations of the spray forming material within the spray-formed metallic tool to a substantially homogenous distribution of commingled metallic phases consisting, for example, of predetermined proportions of at least a bainite phase and a martinsite phase.

6 Claims, 12 Drawing Sheets

OTHER PUBLICATIONS

Fussell et al.; A Sprayed Steel Tool for Permanent Mold Casting of Aluminum; SAE Technical Paper Series; Apr. 22–26, 1991; 1–7; Dayton, OH.

Volenik et al.; Properties of Alloy Steel Coatings Oxidized Dut=ring Plasma Spraying; Materials Science and Engineering; 1997; A234–236; 493–496.

Weiss et al.; Arc–Sprayed Steel–Faced Tooling; Journal of Thermal Spray Technology; Sep. 1994; vol. 3(3); 275–281.

Smith et al.; An Investigatio of the Effects of DropletImpact Angle in Thermal Spray Deposition; Proceedings of the 7$^{th}$ National Thermal Spray Conference; Jun. 20–24, 1994; 603–608; Boston, MA.

Kowalsky et al.; Diagnostic Behavior of the Wire–Arc Plasma Spray Process; Proceedings of the International Thermal Spray Conference & Exposition; May 28–Jun. 5, 1992; 337–342; Orlando, FL.

Murakami et al.; Effect of Temperature Rise of Sprayed Deposits of an Fe–2.19wt.%C– 0.68wt.%Si Alloy During Thermal Spraying on the Structures and the Mechanical Properties; Materials Science and Engineering; 1994; A174; 85–94.

Prinz; Shaping By Deposition; Carnrgie Mellon University.

Steffens; Metallurgical Changes In The Arc Spraying Of Steel; British Welding Journal; Oct. 1966; 597–605.

Bredendick–Kamper et al.; AES Investigation Of Thermally Sprayed $AI_2O_3$ Coatings On Steel; Fresenius Journal Anal Chem; 1991; 341; 346–348.

Crane et al.; Relationships Between Process Variables, Structure and Mechanical Properties Of Arc Sprayed Steel Coatings; First International Conference On Surface Engineering; Jun. 25–28, 1985; 103–118; Brighton, UK.

Kim et al.; Heat Flow In Multi–Pass Arc Spraying Process; Surface And Coatings Technology; 1989; 398–408.

Cronjager et al.; Investigationd About The Machinability Of Arc–Sprayed Steel Coatings; Proceedings Of The Eleventh International Thermal Spraying Conference; Sep. 8–12 1986863–872; Montreal, Canada.

Steffans et al.; The Sonarc Process: Combining The Advantages Of Arc And HVOF Spraying; Journal Of Thermal Spray Technology; Dec. 1984; 398–403; vol. 3(4).

Weiss et al.; Rapid Prototyping Of Tools; Carnegie Mellon University; Oct. 1989; 1–23.

Bhargava et al.; Automated Ejectability Analysis And Parting Surface Generation For Mold Tool Design; Carnegie Mellon University; May 1991; 1–29.

Fussell et al.; Controlled Microstructure Of Arc Sprayed Metal Shells; Carnegie Mellon University; May 1991; 1–26.

Clyens; Rapid Tooling Manufactured By Spray Tool Steel Directly Onto Stereolithography Models.

He et al.; Net Shape Simulation And Control; Proceedings Of The 7$^{th}$ National Thremal Spray Conference; Jun. 20–24. 1994; 415–419; Boston, MA.

Gill et al.; Monitoring Of Residual Stress Generation During Thermal Spraying By Curvature Measurements; Proceedings Of The 7$^{th}$ National Thermal Spray Conference; Jun. 20–24, 1994; 581–592; Boston, MA.

Rastegar et al.; On The Optimal Motion Planning For Solid Freeform Fabrication By Thermal SprayingProceedings Of The 7$^{th}$ National Thermal Spray Conference; Jun. 20–24, 1994; 463–483; Boston, MA.

Harris et al.; Influence Of Wire Composition And Other Process Variables On The Internal Stress Of Arc Sprayed Steel Coatings; DVS; 80; 245–249.

Greving et al.; Effects Of Coating Thickness And Residual Stresses On Bond Strength Of C633–79 Thermal Spray Coating Test Specimens; Proceedings of the 7$^{th}$ National Thermal Spray Conference; Jun. 20–24, 1994; 639–644; Boston, MA.

Knight et al.; Residual Stresses In Thermally Sprayed Coatings; Proceedings of the 1993 National Thermal Spray Conference; Jun. 7–11, 1993; 607612; Anaheim, CA.

Neiser et al.; Use Of A Computer Model To Assist in VPS Parameter Development; Proceedings of the 1993 National Thermal Spray Conference; Jun. 7–11, 1993; 61–66; Anaheim, CA.

Einerson et al.; Intelligent Control Strategies For The Plasma Spray Process; Proceedings of the 1993 National Thermal Spray Conference; Jun. 7–11, 1993; 205–211; Anaheim, CA.

Sprayform Tools and Dies Limited (STD), Video Transcript, publication date at least as early as Sep. 1, 2000.

Radip Tooling—Changing the Face of Manufacturing, Compact Disc Digital Data, dated Oct. 12, 2000, trt: 10:50.

Merle L. Thorpe; and Joseph W. Minge, Spray Metal Composite Tooling, 26$^{th}$ Annual National SAMPE (Society For The Advancement Of Material And Process Engineering) Symposium And Exhibition Apr. 28–30, 1981, pp. 374–382, Figures 1–13 and Table I and II.

Co–pending U.S. Appl. No. 09/683,158 entitled "Method And Arrangement For Implementing Heat Treatment Before The Execution Of Sprayform Techniques" and filed Nov. 27, 2001.

Co–pending U.S. Appl. No. 09/683,160 entitled "Method And Arrangement For Implementing Heat Treatment During The Execution Of Sprayform Techniques" and filed Nov. 27, 2001.

* cited by examiner

Temperature

*Phases, Position #10*

*In-Plain Strains, Position #10*

*In-Plane Stress*

*Temperature*

*Phases, Position #1*

*In-Plain Strains, Position #1*

*In-Plain Strains, Position #1*

*In-Plane Stress*

*Temperature*

*Phases, Position #1*

*Phases, Position #1*

*In-Plain Strains, Position #1*

*In-Plane Stress*

WARPAGE ( OUT OF FLATNESS ) OF SPRAYED METALLIC PLATE
VS. STEADY STATE SPRAY TEMPERATURE

METHOD AND ARRANGEMENT IMPLEMENTING HEAT TREATMENT AFTER THE EXECUTION OF SPRAYFORM TECHNIQUES

CROSS REFERENCE TO RELATED APPLICATIONS

This application is related to and claims the benefit of U.S. Provisional Application No. 60/338,825 filed 5 Nov. 2001, and entitled "Method and Apparatus Incorporating One Dimensional Modeling for Controlling Stresses in a Spray Form Process," the disclosure of which is hereby incorporated by reference herein in its entirety.

BACKGROUND OF INVENTION

1. Technical Field

The present inventions each relate to methods and arrangements for manufacturing spray formed metallic articles; more specifically the inventions relate to such inventive aspects as heat treatment processes for minimizing internal stresses and deflections in produced articles, manipulating temperature and the time periods for hold certain temperatures to establish prescribed multi-phase metallic compositions in produced articles also for minimizing internal stresses and deflections in produced articles, and a unique one dimensional based model utilized for affecting feed-forward control over the spray form process.

2. Background Art

It is a known process to spray form certain articles using moltenizing arc guns having metal feed wire supplied thereto. Further, it is known that volumetric changes occur during cooling of the metal that can produce significant detrimental effects in the finished product, one of the more significant of which is typically manifest as internal stress that is trapped within the substantially rigid article after its manufacture. It is not uncommon for stresses of magnitudes high enough to warp or otherwise cause deformation and deflection in the finished article to occur in uncontrolled spray processes, and even minor deflections due to internalized stress can render conventional spray form processes unusable when precision tooling is required for particular finished products or articles. In another aspect, as the technology and processes for spray forming metallic articles advance, the manufacture of progressively larger monolithic bodies becomes feasible. As a result, however, the volumetric changes experienced during the cooling of the metal in such larger spray formed bodies is becoming more pronounced due, for example, to their greater sizes and thicknesses. The detrimental effects of these volumetric changes experienced within a spray formed article have long been appreciated; not the least of which can be, and often is, the inducement of internal stresses within the article itself.

It is known that molten steel can undergo various phase changes, for example, from austenite to ferrite, pearlite, bainite, martensite, and various combinations thereof as it cools, and that these phase changes involve positive volumetric changes. Previously, it has been postulated that the transformation to martensite can offset the stresses caused by shrinkage that also occurs during cooling. The focus of this idea was that a balance between the positive volumetric changes and the thermal contractions could be effected by the transformation to martensite.

When steel is initially sprayed and still at a high temperature, it is typically one-hundred percent austenite, and as the steel begins to cool, the austenite begins to change into other sister phases. At a relatively high temperature, the first phase transformations are primarily into ferrite and pearlite. As the temperature moves lower, the next transform is into bainite, and at the lowest temperature, transformation to martensite occurs. Even though it was known that these transformations were occurring as the steel cooled, it has been the martensite transformation which has been primarily capitalized upon to provide stress relief to the spray formed body or article.

A current approach to controlling the spray forming process has been through temperature control. In such an approach, temperature is used as an input for robotically manipulating the spray guns. In this approach, the moltenized metal spray is produced using, for example, a number of twin-wire arc plasma torches or guns. The movement and performance of the guns may be automated via computer/robot controls, the surface temperature(s) of the article may be monitored, and the spray pattern responsively adjusted to control the temperature of the body being sprayed. This exclusively temperature based control process, however, is only suitable when considering transformations from austenite to martensite which is only a function of temperature. It is not suited to transformations of austenite to ferrite, pearlite, or bainite because these phase changes are only partly temperature based. Because these transforms are diffusional processes that are also time-based, as well as temperature based, such transformations can occur even when temperature is held constant. Therefore merely monitoring and controlling the articie's surface temperature fails to fully address the problem of internal stresses that occur during the spray forming process.

During the spray form process, the temperature of the moltenized metal droplets that are sprayed onto the ceramic model are significantly elevated above the temperature of the ceramic model and the surrounding atmosphere. Once the droplets leave the spray gun and land on the ceramic model, they become a constituent component of the article being spray formed. A portion of the heat energy input to moltenize the feed metal wire travels conductively into the ceramic model after landing, while a portion of the imposed heat remains in the body of the article being spray formed. The balance of the heat energy is dissipated out into the surrounding atmosphere which is typically the interior space of the spray form cell or enclosure in which the spraying process is taking place. As a result, different parts of the microstructure have traditionally been permitted to have different temperatures during and after the spraying process. This is especially true, for example, in the case of a large stamping tool, such as that required for stamping an automobile inner hood, if the tool were sprayed as a unibody monolith.

In another aspect, spray formed articles having complex shapes that cause different regions of the article to have relatively different locally exposed surface areas tend to cool at different rates amongst these several regions. This characteristic, in turn, affects the kinetics of the body's overall cooling profile. Different areas of an irregularly shaped article, especially an article having many undulations, tend to cool at different rates, for example, because the presence of the undulations tends to restrict heat transfer. Thus, areas within depressions of the undulations tend to be hotter than areas that protrude with a proportionately greater exposed surface area. As a result, one part of the article being sprayed can be in the bainite transformation phase, while another part is in the martensite start region.

Further, when spraying is discontinued and the sprayed article is allowed to cool to room or ambient temperature, different temperatures will begin to occur across the sprayed body. As a result, those areas loosing temperature more quickly begin to traverse the phase transformations sooner than those areas that are more heat retentive. This phenomenon is even more pronounced with a sprayed article that has a complex shape, such as those including undulations or apertures, which causes certain areas to be warmer than others until the final cooling temperature is reached and the article assumes a uniform temperature, such as equal to the temperature of the spray form cell's interior. When such articles are simply allowed to cool to room temperature in an uncontrolled manner, significant distortions are likely to occur in the article because of discontinuities across the phase transformations and stresses are created in the bodies because of these different cooling rates.

Currently available technology provides the user with an ability to monitor the exposed surface temperature of an article being spray formed. However, in spite of the recognized need, a continuing failure in the art has been a lack of means and method to accurately predict, monitor and control the more elusive, but more comprehensive, time and temperature dependent phase constituencies and volumetric changes that occur during the spray forming process. Consequently there has been a continuing inability to affect proper control over the time and temperature based phase constituencies and volumetric changes during the spray forming process for obviating the problems associated with internal stresses induced in the article being spray formed.

In view of the above described deficiencies associated with currently available spray form processes when considering time and temperature dependent phase and volumetric changes within the article being formed, the present inventions have been developed to alleviate these drawbacks and to provide further benefits to the user. These enhancements and benefits are described in greater detail hereinbelow with respect to illustrative embodiments of the inventions.

SUMMARY OF INVENTION

FIG. 1 shows an example of a basic graph plotting time, temperature, and phase transformation for a typical carbon steel, also known as a TTT curve, which indicates several different general zones. In a top portion of the graph at temperatures, for example, above about 750 C, sprayed metal remains in a stable austenite phase regardless of the time held at this temperature. Moving down on the temperature scale (y-axis), at the left side of the mid-portion of the graph, an austenite phase is also found, but in an unstable condition. This condition is based on lower temperatures between, for example, about 210 and 720 C for the particular steel for which the TTT curve is plotted, at which the metal is sprayed on the ceramic model.

Moving to the right on the graph, it can be seen that this unstable austenite phase lasts but a short period of time, which is apparent based on the x-axis that shows time on a logarithmic scale. Moving to the right as time passes, the unstable austenite zone is left behind and a middle and transitional zone is entered which is characterized by some or all of the austenite converting to a ferrite and/or pearlite phase of metal. As more time passes, a third zone is encountered which is characterized by conversion of austenite to bainite. A fifth zone is located at the bottom portion of the graph and is characterized as a martensite zone. Moving through any of the zones, the conversion of austenite to the indicated phase (ferrite or pearlite, bainite, or martensite) is gradual. Therefore, depending on time, it is possible to move across a multitude of zones, resulting in a multitude of different material phases in the finished spray formed article.

Each of the transformations includes a certain degree of inherent volumetric expansion of the constituent metals. In the past, attempts have been made to capitalize on this expansion (potentially causing compressive strains in the spray formed article) to counteract contraction of the metal resulting from cooling, which would otherwise cause tensile strain to be induced in the spray formed article. An aspect of the present invention(s) includes an enhancement to these concepts and an appreciation and control of certain phenomenon which enable the inventions. Such enhancement involves, for example, an appreciation that the two variables of the graph of FIG. 1, the same being temperature and duration maintained at particular temperatures, can be manipulated to achieve more precise volumetric expansion in the spray formed article. That is to say, by manipulation of temperature, and the periods of time that certain temperatures are held, it is possible to "move around," and into and out of the various phase transformation regions.

It should be appreciated that once a portion of the original austenite phase has been converted, it cannot generally convert to yet another metallic phase. The exception, of course, being that a reconversion back to austenite can be accomplished should the temperature be elevated quite high, such as above about 720 C as represented in FIG. 1. This situation, however, is not treated in the present disclosure. That being said, when considering feasible temperatures for spray form processes, it is only possible to achieve a one-hundred percent conversion of austenite to martensite if the application temperature either begins below about 210 degrees C., or quickly drops below that temperature before crossing the interface line into the pearlite-ferrite (middle) zone. Once a certain amount of time has passed causing a portion of the austenite to convert to pearlite, ferrite, or bainite, that converted portion cannot convert to martensite, even if the temperature is sufficiently lowered into the martensite zone. It must be appreciated that it is still likely that a portion of austenite phased metal still remains in the multi-phase "mixture" which constitutes the sprayed tool or article. This austenite portion of the metal that has not converted because sufficient time was not spent in the intermediate pearlite-ferrite zone, can be converted to bainite if the temperature is held steady or raised. If the temperature is lowered so that entry is made into the martensite zone, whatever portion of the austenite that remains unconverted at that time is available for conversion to martensite, which is substantially exclusively temperature dependent.

One aspect of the presently disclosed inventions involves the controlled manipulation of both temperature and time for strategic phase changes that result in a specific and planned volumetric increase. This manipulation is made based on ongoing spray parameters, such as the heat energy added to the wire being moltenized and sprayed to form the article. Another aspect of the present invention considers adding heat and raising the temperature after the article's temperature has dipped down into the martensite zone, taking the temperature back up into any of the three mid-zones (austenite, pearlite-ferrite, and bainite) before complete conversion to martensite occurs. Referring to FIG. 1, it must be remembered that horizontal progression across the three mid-zones is time dependent. In other words, the temperature must be maintained within the mid-zone range for the indicated requisite period(s) of time for one-hundred percent conversion of the austenite to be affected. Otherwise, there will remain a mixture of mixed-phase metals, with that portion which remains as unconverted austenite still being available for conversion to ferrite, pearlite, bainite, and/or martensite depending upon subsequent temperatures levels and, and the durations for which those temperature levels are held. It should be appreciated that the prescribed temperature manipulation may be affected during the spraying process, or after the article has been completely formed.

In one aspect of the inventions, it has been appreciated that one of the reasons that stress can be minimized in a spray formed article is that through purposeful control over magnitude and duration of imposed temperatures, the body of the article can be formed to be of mixed and interspersed metal phase makeup. That is to say, after the spray form process is completed and the article cooled and ultimately removed from the ceramic model upon which it has been sprayed, the constituent metal phase makeup can be controlled to be a mixture of martensite, pearlite-ferrite, and/or bainite. During the spray process, or because of post-heat treatment of the body after termination of the spray process, certain portions of austenite phased metal may also be retained until the temperature is lowered causing martensitic transformation, or sufficient time passes permitting the austenite to convert to pearlite-ferrite or bainite.

Certain of these interspersed phases are "softer" and/or more malleable than the other surrounding phases. As a result, these more malleable constituent phases act as buffers and absorb the expansive affects of a phase transition which has occurred nearby. That is, the harder expanding phases can press into the more malleable phases which tend to "squish" out of the way. Additionally, the harder and less yielding phases are able to "slide" across the more malleable portions. The deformation or "give" of the softer phased material is of a plastic nature, as opposed to elastic nature, and therefore there is no tendency for recoil or tension back to the pre-deformation configuration. As a result, strategic formation of intermixed metal phases has been discovered to avoid and minimize the inducement of stress and strain in the finished article. For this affect to be experienced across the article, the commingling of these different phases must be induced in the body of the spray formed article. The effects of this type of manipulation have heretofore gone unrecognized and therefore have not been capitalized upon via purposeful control of the spray form process. It should be appreciated that this control may be exercised during and/or after the actual spraying processes are complete.

A further aspect of the presently disclosed inventions involves manipulating the temperature of the article being spray formed in such ways as to bring all areas of the sprayed article to a uniform temperature to enable cooling at a more nearly uniform rate across the article and to enable the avoidance, for example, of different proportional combinations of metal phases across the article which could result in imbalanced stress relief. In spray forming processes, it is known that complex shapes and large articles present a problem when a uniform temperature is desired to be maintained across the entire body being spray formed, particularly when the entire spraying process is considered. Based on the descriptions above, the need to be able to control temperature changes in the body of the article being sprayed is easily appreciated. Therefore, the present aspect of the invention contemplates the utilization of heat treatment processes that assure that the metallic organization, prior to cooling, has proper phasing so that when cooled, the thermal shrinkage factor for the article is counteracted. Therefore, the entirety of the sprayed body may be held above a certain threshold temperature thereby enabling controlled conversion between austenite to martensite, as well as other phase transformation throughout the body. This control technique is a key to being able to "scale up" traditional processes for utilization in forming progressively larger spray formed bodies; exemplarily, on the order of eight feet by eight feet. Tools of this size may be used to stamp-manufacture such large items as automotive hood and trunk or boot covers. Previously, such large tools could not be manufactured as a unibody or monolith using spray form techniques because unacceptable warping of the finished product or tool could not be avoided.

Implementation of a pre-heat treatment aspect of the present invention before the spray forming process begins involves preheating one or more of the interior space of the spray forming cell, related enclosure(s), and/or the mold substrate upon which the moltenized metal is sprayed. In a process performed according to the teachings of the present invention, application of the metallic spray forming material onto the mold substrate is initiated inside the heated cell. Because the heated environment of the cell can be held nearly constant, or varied as desired by the operator, substantially uniform combinations of metallic phases can be caused for inducing near uniform phase transformations and resulting mixtures of commingled phases across the spray formed body. For example, controlled transformations from the austenite phase can be fostered based on temperature manipulations within the cell. Control of the temperature variations is guided by a predetermined relationship between the initial application temperature of the spray forming material and its correlation to initial temperatures of either or both of the preheated cell environment and the preheated mold substrate.

Implementation of heat treatment during the spray forming process involves applying the metallic spray forming material onto the mold substrate under heated environmental conditions which can be manipulated to cause substantially homogenous metallic phase transformations from the austenite phase, for example, via manipulation of either or both of the substrate temperature and the spray forming cell's environmental temperature. Sometimes substantially homogenous metallic phase transformations are not desired, but instead customized characteristics are required. In these cases, the temperature of the spray form environment can be appropriately controlled to cause the desired effects through varied metallic phasing across the sprayed metal article.

Implementation of post-heat treatment after spray forming has ended, according to that aspect of the present invention, can include further heating, but more typically involves controlled cooling of the cell environment. The controlled temperature drop may be uniform, or quite abrupt at certain strategic times. For instance, certain transformations are time based, as well as temperature based. This can be appreciated when considering FIG. 1. Therefore, the controlled descent from the heated temperature can be used to cause substantially homogenous, or controlled mixtures of the metallic phase transformations and final phases throughout the resulting spray formed metallic article or tool. Desirably, this causes a substantially homogenous distribution of commingled metallic phases consisting of predetermined proportions of at least bainite phases and martensite phases. By purposefully imposing such a commingled distribution throughout the spray formed body, stress has been found to be more effectively dissipated by the cooling body. Among other reasons, this stress dissipation is accomplished by the inducement of interstitial or mixed phases in which at least one is more susceptible to plastic deformation at lower shear levels than the other(s). As described above, this characteristic facilitates relative "sliding" in the softer phases by the less yielding phases which are also typically volumetrically more expansive upon cooling. This combination of characteristics contribute to the present inventions' successful counterbalance of shrinkage resulting from the cooling of the article which had heretofore caused internal stress, and even worse, warping of the finished article.

Another aspect of the present inventions makes use of what is referred to as one-dimensional modeling to control the spray forming process. In this model, characteristics of a geometrical point are quantified by iterative detection, such as repeatedly taking surface temperature readings using a pyrometer as more and more metal is sprayed. At specific times during the spray forming process, key properties of the body being sprayed are measured and provided as input to the model as initial conditions; the model then uses an optimization algorithm to determine the best control scheme to use until the properties are next measured. In this way, this system of one-dimensional modeling may be characterized as being of the feed-forward type.

Temperature is but one example of the type of data that might be collected at each sampling time to be used as input into the model. Exemplarily, surface temperatures of the spray formed article may be iteratively sensed using a pyrometer. The one-dimensional model, using both historical data and presently sensed data, quickly determines how the spray forming system should be controlled and operated during the next time lapse until the input data is read again. Conceptually, it can be considered that certain characteristics of a core or column representing "a point" down through the depth of the article is sensed in layers. The lower layers are thenceforth modeled or theoretically represented after their actual scan since those layers are now contained below the surface of the article and not susceptible to having most qualities directly measured again. FIG. 1A provides an illustration of such a modeled column representative of actual characteristics. The more "columns" that are detected and analyzed, such as a honeycomb configuration of columns, the greater the proportion of the whole of the body of the article being spray formed that can be modeled.

An alternative version of the one-dimensional modeling process described above may be based solely on an input value, rather than a sensed measurement. If that is the case, an original input may be provided to such a model for initiating control of the entire balance of the process. Still further, such a model may be utilized to "virtually" analyze different spray conditions without incurring the time expenditure and cost of laboratory testing.

An important advantage of the one dimensional modeling approach is that it can be performed (calculated) very quickly using algorithm-defined, computer-based modeling strategies. In other words, each point-column can be quickly computed and information deduced about characteristics of the particular column at different depths within the spray formed article. The more frequently the sensed points and corresponding columns are spaced across the article, the more continuous the information that can be deduced. Consequently, the more points that are reported, the greater the proportion of the sprayed article that can be analyzed by the one-dimensional model, and the better the predictions will be about how best to modify the spray gun control parameters for the next layers. By straightforward extension of this principle, the one-dimensional modeling program can be written to consider regional characteristics based on a collection of adjacent columns.

The beneficial effects described above apply generally to the exemplary devices, mechanisms and method steps disclosed herein with regard to real-time and predictive monitoring and control of metal spray form techniques. The specific structures and steps through which these benefits are delivered will be described in greater detail hereinbelow.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 2:
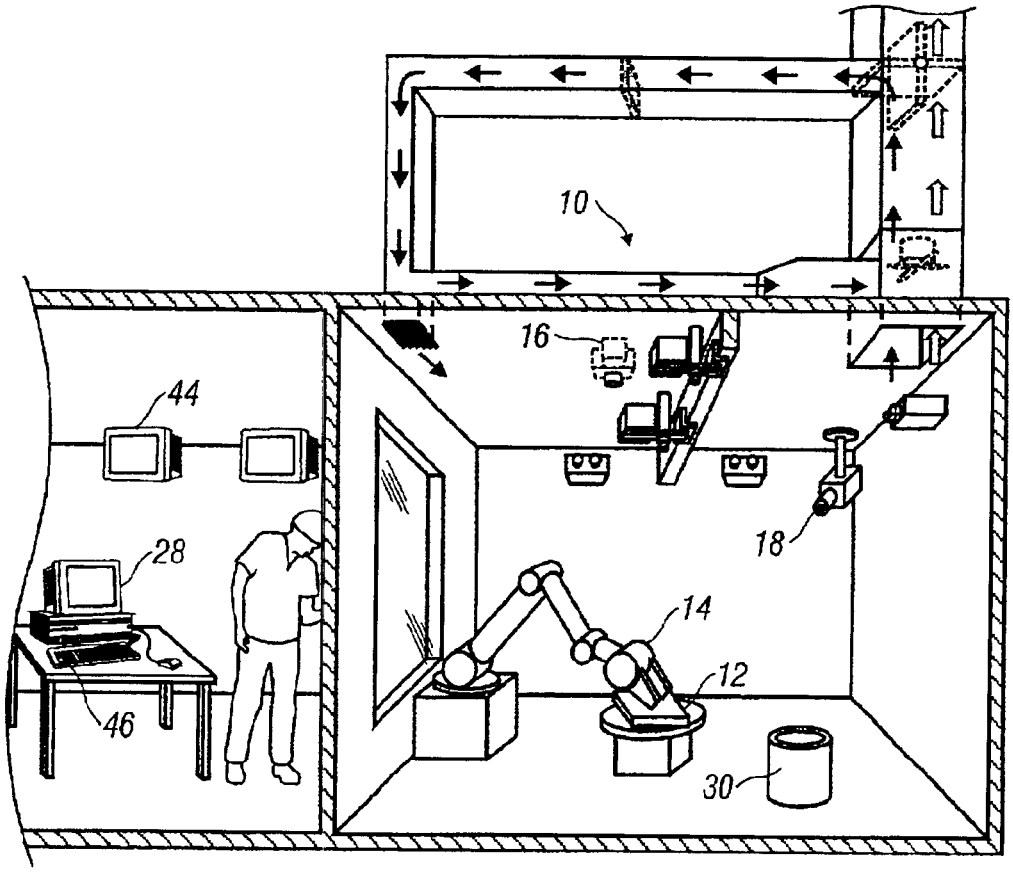
FIG. 2 is a partial sectional, perspective view of the interior of a spray form cell, together with an adjacent monitoring and control room having an observation window positioned therebetween and a heating and circulation arrangement configured thereupon.

FIG. 2 illustrates an example of a spray form cell suitable for making a tool by spray forming molten steel onto a ceramic substrate according to an embodiment of the present invention. Within the cell 10 is a model-carrying platform or table 12, spray guns or torches 14, a temperature measuring device, such as a pyrometer 16, and a video camera 18 connected with a monitor 44. The pyrometer 16 measures surface temperature, and a cable may exemplarily connect the pyrometer 16 to a programmable computing device 28 having an input mechanism 46 in an exemplary form of a keyboard. The wire arc torches or guns 14, likewise connectable to the computing device 28, are used to deposit molten steel onto a ceramic master model and operate in a programmed raster pattern at a predetermined height above the ceramic model's exposed surface. The table or platform 12, also connectable to the computing device 28, can be mechanized to vary the movement, including rotation rates, orientation, and position of the model during the molten metal deposition process.

As will be described herein and which is illustrated in the accompanying drawings, one aspect of an embodiment of the present inventions considers that, in addition to austenite-to-martensite transformation, several other factors play important roles in effecting stress relief during the spray forming process, one of which is austenite-to-bainite transformation. In the typical time-temperature-transformation (TTT) graph shown in FIG. 1, the horizontal axis is time, which is measured logarithmically, and the vertical axis is temperature measured in degrees Celsius. The illustrations of this graph provide conceptual support for various embodiments of the present inventions.

The martensite start (MS) temperature is the temperature at which the transformation from austenite to martensite begins. The TTT graph for steel is generic and is generally similar in shape for steels of varying carbon content. At temperatures above the MS temperature, there is 100% austenite and zero percent martensite. If cooling occurs very quickly to a low enough temperature such as below 100 C, the nose of the TTT curve is missed and transformation of the austenite results in 100% martensite. In other words, at high temperatures, everything is in the initial austenite phase, and if cooling occurs very quickly, the austenite is all transformed to martensite. However, if cooling occurs slowly, down to a certain point there is 100% austenite, and then pearlite begins to first form and can increase, for example, from zero percent pearlite up to 100% pearlite-ferrite over time. However, as soon as the MS temperature is passed, if any austenite remains, the austenite begins to transform to martensite.

The transformations to ferrite, pearlite and bainite require time for diffusion to occur. In other words, the transformation from austenite to pearlite begins after it is held at a particular temperature for a certain period of time and passes the "transformation begins" line on the TTT curve. The longer it is held at the particular temperature, the greater is the amount of the austenite that is converted to pearlite or ferrite. By the time the "transformation ends" line is crossed by continuing to hold at the particular temperature, there will be a one hundred percent transformation to pearlite-ferrite. However, if the temperature is held for a shorter period of time before the "transformation ends" line is crossed, for example, until only fifty percent of the austenite is transformed, there is fifty percent austenite and fifty percent pearlite-ferrite. By suddenly cooling at that point to a temperature below the MS temperature, the remaining fifty percent austenite begins to transform to martensite, so there is the possibility of ending up with fifty percent martensite and fifty percent pearlite-ferrite.

As mentioned, TTT graphs are typically similar, including the ferrite-pearlite, bainite, and martensite phases. It is only austenite that transforms, and once austenite transforms to another phase, such other phase does not transform again unless the temperature is significantly raised, such as up to tempering ranges; for example above 750 C. Thus, the austenite transformations can result in variable relative amounts of the other metal phases being produced. The diffusive transformation phases, namely austenite to pearlite, ferrite and bainite, are all time-based. The longer the requisite temperature is held in one of the pearlite, ferrite or bainite regions, the more austenite that is transformed to the corresponding phase. However, martensite is different. Above the MS temperature, there is no transformation to martensite. If the temperature is decreased to a temperature just below the MS temperature in the martensite zone corresponding, for example, to 5% martensite, no additional martensite will be transformed no matter how long it is held at that temperature. The temperature can be held, for example, for days, but no more that 5% martensite will be formed, no matter how long the temperature is held. Thus, the transformation to martensite is not diffusive or time dependent, but it is temperature dependent instead.

As mentioned above, the other phases, namely pearlite, ferrite, and bainite are diffusive or time dependent. If the temperature is held longer, more austenite is transformed to those phases. So, the key to transformation of austenite to martensite is temperature. As the temperature falls further below the MS temperature, more martensite is transformed, until the martensite final (MF) temperature is reached, at which point, if there was 100% austenite, it is transformed to 100% martensite. That differentiates martensite from the other microstructures. If the temperature is lowered to ambient temperature very quickly, all of the austenite is transformed to martensite. While in theory, there is 100% martensite in that case, as a practical matter, there is always a small amount of retained austenite that varies with alloy content and which is difficult to remove unless the material is cooled well below room temperature. For example, there is typically perhaps 4% to 10% retained austenite, which is not important as a practical matter.

All of the phase changes have an associated volumetric expansion, the largest of which is martensite. The formation of bainite has the next largest volumetric expansion, and the formation of pearlite and ferrite have the least volumetric expansion. Since the greatest volumetric expansion is associated with the transformation from austenite to martensite, the formation of martensite is significant in causing the offset of thermal contraction. However, in addition to the volumetric expansion associated with martensite formation, bainite formation also has a significant role in combination with the formation of martensite in offsetting thermal contraction.

One aspect of the present invention involves, for example, controlling the formation of selected metallic phases by cooling to a predefined temperature and holding at that temperature for a predetermined period of time and thereafter increasing the temperature gradually for formation of certain of the other metallic phases. That occurs, for example, by having the substrate temperature initially at a temperature, such as 250 C before spraying commences, which is below the MS temperature. It should be noted that the MS temperature is a function of the carbon content of steel, and that the MS temperature is lower for steel with a greater carbon content. The interstitial carbon impedes the atomic rearrangement of iron from the austenite to martensite structure, so the thermodynamic driving force required for transformation increases with carbon content. This driving force is achieved by further lowering of the temperature. Thus, the higher the carbon content in the steel, the lower the MS temperature, and austenite transforms to martensite at a lower temperature. Further, the TTT curve is shifted with changes in the carbon content of the steel. For a lower content carbon steel, the TTT curve is shifted left relative to the horizontal time axis, and it becomes more difficult to quench or cool the steel quickly and miss the nose of the curve. It should be remembered that the horizontal time axis is logarithmic, so when the TTT curve is shifted left, very little time passes before the noses of the TTT curve is reached for a low carbon steel. On the other hand, with higher carbon steels, the nose of the TTT curve is shifted right relative to the horizontal time axis, and more time is available before the nose of the TTT curve is reached.

For purposes of illustration, assume that an initial temperature of the substrate on which the moltenized metal is sprayed is 250 C at the time spraying is commenced and that the MS temperature of the steel being sprayed is, for example, 260 C. When spraying begins, the sprayed steel that initially contacts the substrate is cooled to near the initial temperature of the substrate. Since the substrate temperature is below the MS temperature, at least a small amount of martensite is formed. Thereafter, as succeeding layers are sprayed and built up while spraying continues, the temperature of the substrate increases and saturates and remains at a higher temperature. When the temperature is measured, for example, using infrared imaging techniques and plotted against time during the spray forming process, the surface temperature of the ceramic substrate is below the MS temperature at the beginning. However, after several minutes of spraying, the temperature increases until it saturates and thereafter remains generally constant. Therefore, martensite is formed initially, and as the temperature increases to saturation above the MS temperature, which is only a little above the initial temperature of the ceramic substrate, other phases, such as bainite, are formed. Under these conditions, stress control has been achieved.

This is in part because the martensite conversion is not dependent on time. As long as the temperature is held constant below the MS temperature, the amount of martensite converted remains the same. Thus, the temperature can be held for a period of time and theoretically no more martensite is formed. However, the martensite can temper with time. A regular martensite is the hardest of all the phases. If the temperature is dropped quickly to the MS temperature, the martensite that is formed is very hard and brittle. If it is used for tool applications, it is easy to crack or fracture. In fact, it is so brittle, that if the cooling rate is too quick, sometimes the martensite that forms already has cracks in it. Bainite, however, is more ductile and tougher than martensite because it is more malleable and softer and pearlite and ferrite are significantly softer than martensite. This softness relates to what is called plasticity and elasticity. Elasticity implies a notion of reversibility in that an object that is subjected to tension and released will return to its original shape. However, plastic deformations are irreversible, and if the object is strained and released, it recovers only the elastic part of the deformation. The plastic or permanent deformation remains and is characterized as dislocations or stretches in the steel. Accordingly, it is not desirable to quench a metal article, especially a sprayed metal article intend for such uses as stamping tools and the like, too fast thereby causing the article to be too brittle. In other words, it is important to have a material that can sustain a certain amount of plastic deformation without breaking. Materials that possess such ability to be plastically deformed are referred to as being "ductile" or "tough".

Bainite is softer and can absorb more stress than the harder martensite; therefore, the plasticity imparted by bainite's inclusion in the microstructure of a spray formed article is a substantial advantage. In order to have bainite and the toughness that it imparts in an article, the spray forming process may be controlled to either raise or maintain the temperature of the steel above the MS temperature for the particular steel for a long enough time that, based on time and temperature, a plotting of these variables crosses the "transformation begins" line for bainite on the TTT curve as may be appreciated from FIG. 1 of the accompanying drawings. In another aspect of the present invention, bainite and toughness are attained by lowering the temperature to the "transformation begins" line for bainite and then holding the temperature for a requisite period of time. Since bainite formation is time dependent, the longer the elevated temperature is held, the more bainite is formed.

When the spraying process is stopped and the spray formed tool is allowed to air cool, the remaining austenite transforms to martensite, with some combination of bainite and martensite then constituting the sprayed article. The bainite and martensite phases are commingled in the sprayed material, with the bainite lending toughness to the otherwise hard martensite phases or zones. An important aspect of at least one embodiment of the present invention is the capitalization on not only the volumetric expansion characteristics of the martensite transformation for stress relief, but also the institution of an advantageous ratio and commingling of softer and tougher bainite with the harder and more expansive martensite which together accomplish the required stress relief in the spray formed article.

An important aspect of the present invention relates to when transformation occurs in the spraying process. It had been postulated that by simply cooling the spray formed tool below the MS temperature as soon as it was sprayed, the austenite would be converted to martensite instantaneously with a commensurately instant stress relief being affected. However, it has been found that a key aspect of the stress relief achieved via the present invention(s) is the timing of when the transformations are permitted to occur. If all of the austenite transforms to martensite quickly at the beginning of the spray process, an offset does not occur because there is no austenite left to transform to other phases, such as bainite. On the contrary, stress relief is accomplished according to at least one embodiment of the present invention by carefully balancing between causing some, but not all, of the austenite to transform to martensite by lowering the temperature below the MS temperature, but as spraying continues, holding the temperature for a sufficiently long time to cause at least some of the austenite to be transformed to bainite.

Having discussed the basics of austenite's decomposition hereinabove, it should also be explained that both martensite and bainite can temper, and this tempering process is also diffusive. Tempering involves the formation of fine carbides within the bainite and martensite, and the material changes both its size and mechanical properties as a result of such tempering. Tempering is, therefore, a part of the one-dimensional simulator which will be described hereinbelow, and plays an important part of the overall control of stress, distortion, and final microstructure.

The ability to plastically deform is an important quality of the resulting spray formed product, but plastic deformation that occurs during the spray forming process and subsequent cooling is a key aspect of how stress and distortion or deflection control is achieved according to the teachings of the present inventions. As several of the accompanying plots of strain show, cooling and contraction of the sprayed article causes stresses to build up that would crack the part if compensation is not provided. Even with the volumetric mitigating effects of the phase transitions, were the material not able to plastically yield and deform to keep the stress level below that associated with fracture, the sprayed product would deflect, deform and possibly crack or otherwise damage itself. More subtle still, plastic deformation limits the build up of stress to the "yield stress" of the material so that the phase transitions need only offset the stresses and strains below this yield threshold. The plastic deformation thus puts a cap on the amount of stress relief that the phase transitions must accomplish.

Therefore, in at least one aspect, the present invention assures that enough plastically yieldable metal phase material, such as bainite, is established by phase transformation control throughout the body of the spray formed article to guarantee that plastic deformation or stretching will occur before cracking or other structural failure in the article. The elastic component of the deformation which has a stress force urging the material back toward its original configuration is retained in the body with a commensurate amount of strain associated therewith. This stress which may not crack or otherwise cause failure, but is often quite capable of causing deflections in the spray formed article, is then counteracted or compensated for by volumetric expansion of the constituent phased materials, usually by expansive conversion of austenite to martensite. In other words, the plastic deformation afforded by the presence of the more ductile and tough austenite and bainite phases during the spraying process act as a maximum strain "pressure-type valve" that releases strain by plastically yielding or stretching before a failure, such as a crack, occurs. After the spraying process ceases, or at least in a later phase of the process, conversion of typically austenite to martensite results in a volumetric expansion that counteracts the elastic stress component still held in the body of the spray formed article. By purposeful control, the relative proportions of the several material phases (i.e., austenite, bainite martensite and the like) can be established at different times during a spray formed article's manufacture to assure sufficient plasticity and elasticity when needed, as well as volumetric compensations to control, and usually minimize, internal stresses and strains in the finished spray formed product. As discussed herein, control, according to these inventions, is exercised over both temperature magnitudes in the article and the durations over which certain temperatures are held. To this end, historical analysis is employed that determines conditions in sub-surface regions of the article. Feed forward analysis and control, such as the one-dimensional modeling described hereinbelow, is employed to control future actions of the process for instituting and/or maintaining desired conditions in both existing regions of the article, and regions being spray formed in the future.

FIGS. 3–16 show plots that help to illustrate the relationships among plastic deformation, phase transitions and stress associated with spray forming. These plots were generated using a one-dimensional model for the through thickness direction; that is, a model that looks at a straight line going from the top of the spray formed article to the bottom of the ceramic model upon which the article is being formed. The scenarios shown here illustrate, for example, how differences in the starting temperature of the ceramic can cause large differences in the phases formed, the plastic strains that occur, and ultimately the final state of stress in the material.

Figure 3:
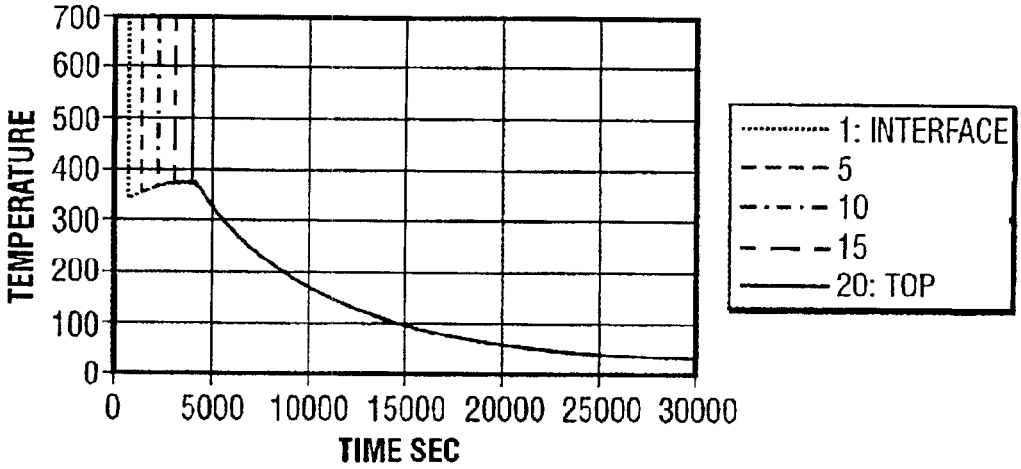
FIG. 3 shows a plot of temperature against time for a spray forming process using a steel with a MS temperature of about 400 C and an initial ceramic mold temperature of 375 C, which was generated using a one-dimensional model and which illustrates an example of what happens if the temperature is held slightly below the MS temperature.

For the plots of FIGS. 3–11, the steel is 0.2% carbon, the initial temperature of the ceramic is 375 C., and the MS temperature is about 400 C. FIGS. 3–6 show an example of what happens if the temperature is held just a little below the MS temperature. In FIG. 3, information is shown for five positions within the article being spray formed. The first position is near the interface with the ceramic, and the twentieth position is near the free surface (top) of the article being spray formed.

Figure 4:
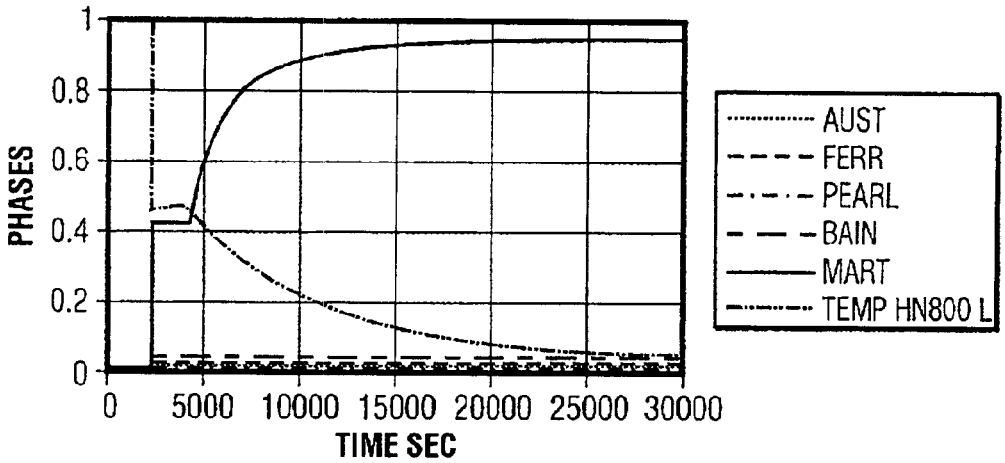
FIG. 4 is a plot that shows how phases change with time in the spray forming process of FIG. 3 of special interest, is the fact that nearly all of the austenite transforms to martensite.

The plot of FIG. 4 shows an example of how the phases change with time. The vertical axis shows the forming fraction going from zero to one. The plot uses a position in the middle of the article being spray formed for the example. Initially, there is 100% austenite and zero percent martensite. As the spray formed article begins to cool, there is less of one phase and more of the other, because the sum must be one. Thus, according to the plot, as cooling occurs, martensite is formed and the other phases, ferrite and pearlite, are very low or almost nonexistent. On the particular plot, the top part of the TTT curve has apparently been missed, and if anything else is formed, it would be bainite and martensite, even though the bainite is in very small amounts.

Figure 5:
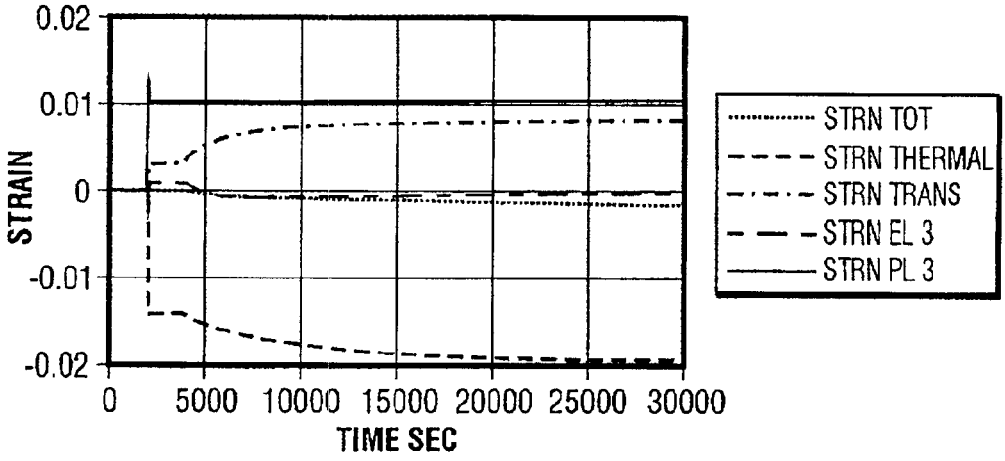
FIG. 5 is a plot which shows how strains develop with time in the spray forming process of FIG. 3.
Figure 6:
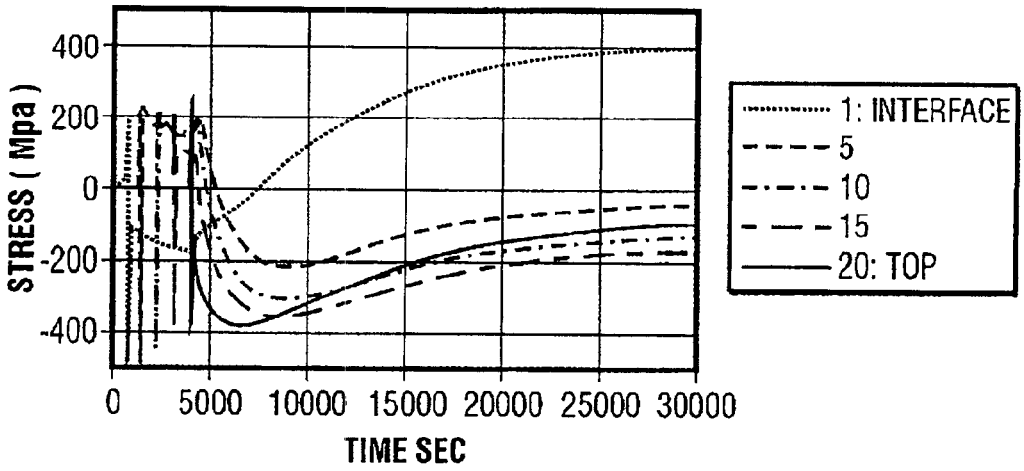
FIG. 6 is a plot which shows an example of residual stresses after the spray forming process of FIG. 3 has terminated.

The plot of FIG. 5 shows an example of how strains develop with time, which separates all of the times in which the various phases begin to arise. The key here is that a large amount of martensite is forming during the final cool down, so the martensite strain looks somewhat like the mirror image of the thermal strain during the final cool down. In other words they are counteracting one another, which is desirable. The plot of FIG. 6 shows an example of residual stresses after the process is over. The high stress near the interface is due to the fact that bainite and martensite form very quickly at that location, and there is nothing to offset the thermal contraction at the end of the process. The transformation from austenite to martensite occurs very quickly at the beginning of the process, so later on in the process there is no austenite left for conversion to bainite to offset the martensite.

The total or residual strain shown by the plot in FIG. 6 is a combination of the elastic strain and the plastic strain. The plots illustrate that plasticity is important for the transformation of strain. When transformation occurs, there is plasticity locally. Assume, for example, that the material is initially 100% austenite. As the material is cooled slowly to a relatively high temperature, but below the MS temperature a small amount of martensite begins to form. Martensite is much harder than austenite, so as the martensite grows, it impinges on the softer material and deforms the softer material past its yield value as time elapses. This permanent deformation above the yield value is plasticity, while deformation below the yield value is the elastic part of the curve. If the material is strained up to the yield value and allowed to recover, it is not possible to know that it was ever stressed or strained, which is elasticity. However, as it is strained further, the curve begins to bend over, and when it is unloaded, while the elastic strain or elasticity is recoverable, the plastic strain or plasticity cannot be recovered.

Figure 7:
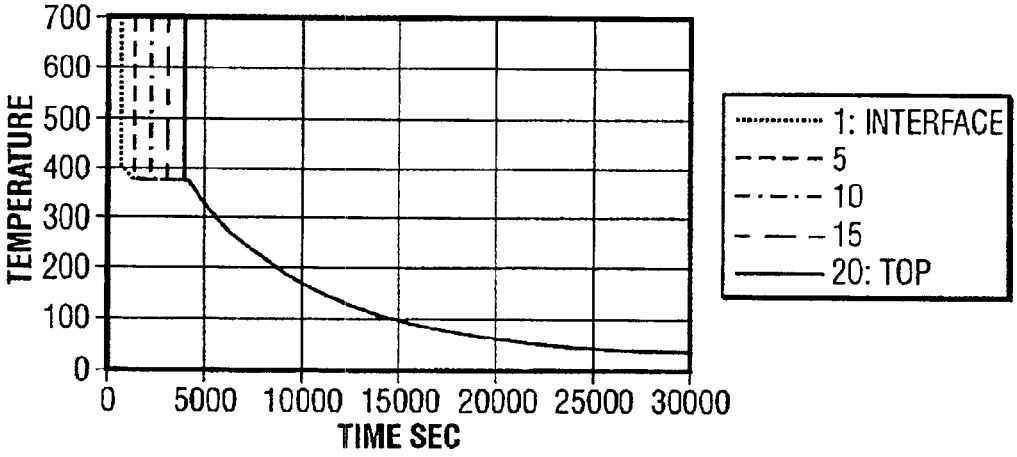
FIG. 7 shows a plot of temperature against time for a spray forming process using a steel with a MS temperature of about 400 C and an initial ceramic mold temperature of 400 C, which was generated using a one-dimensional model and which illustrates an example of what happens if the time-average temperature is held above the MS temperature. Figure shows that there is a fine scale fluctuation in the temperature during the initial deposition process that, collectively, includes enough time above MS for a significant amount of bainite to form.
Figure 8:
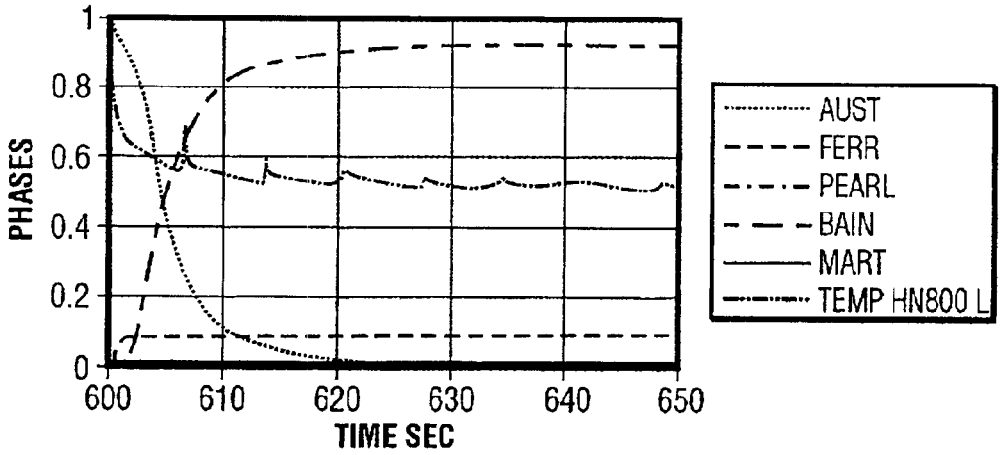
FIG. 8 is a plot which shows how phases change with time in the spray forming process of FIG. 7.
Figure 9:
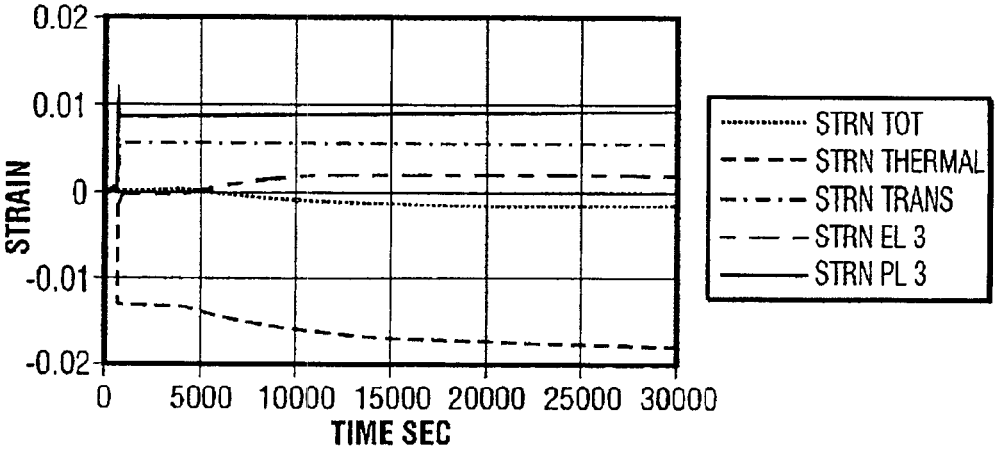
FIGS. 9 and 10 are plots which show how strains develop with time in the spray forming process of FIG. 7.
Figure 10:
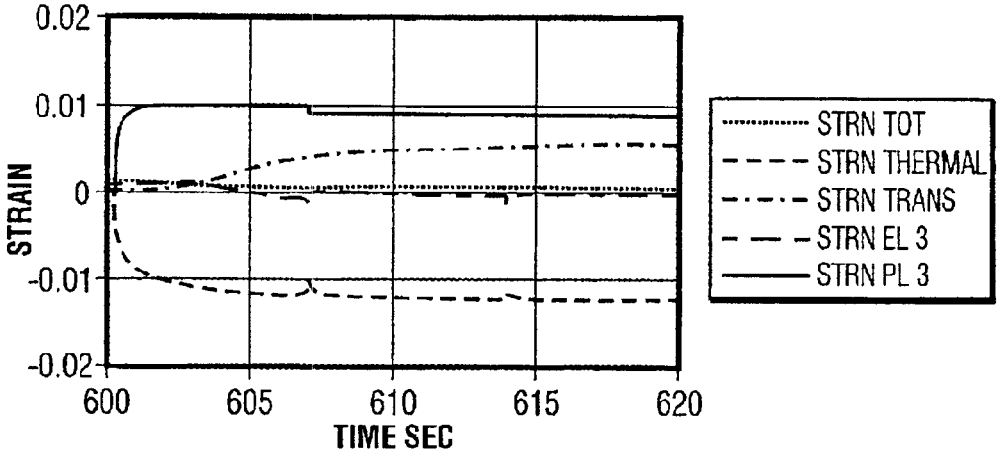
Figure 11:
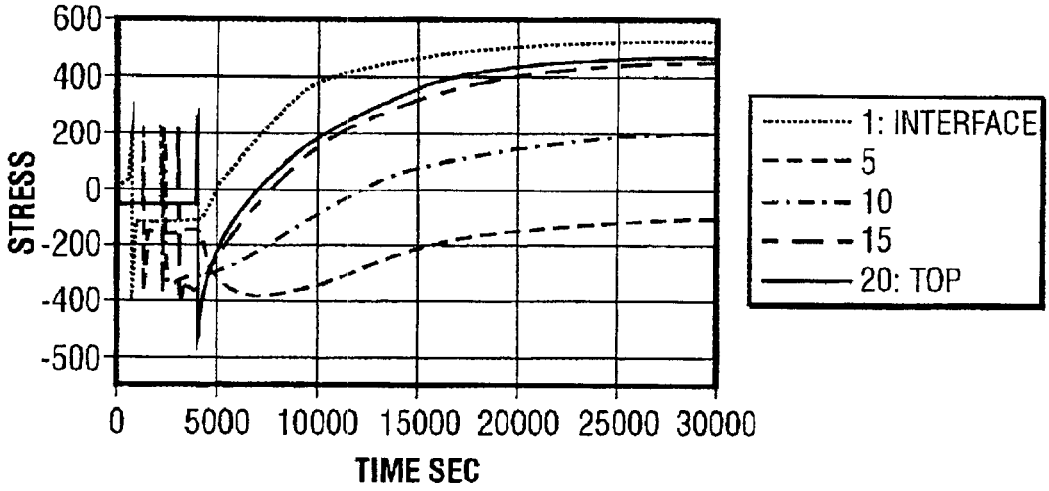
FIG. 11 is a plot which shows an example of residual stresses after the spray forming process of FIG. 7 is over.

FIGS. 7–11 show an example of what happens if the material is held above the MS temperature. In FIG. 7, information is shown for five positions (at five cycle iterations) within the spray formed article. The first position is near the interface with the ceramic, and the fifth position is near the free or exposed surface (top), which is the last part that is sprayed. FIG. 8 is a plot that shows an example of how the proportional amounts of the several material phases change time. The several plots track austenite, pearlite, ferrite, bainite and martensite. Here, the austenite transforms to bainite very quickly, and since it happens so early, there is little left for subsequent transformation, for instance to martensite, to offset the thermally induced strains. FIGS. 9 and 10 are plots that show an example of how the strains (strns) develop over time. In FIG. 9, the spray formed body ends slightly in compression after about 7500 seconds. In FIG. 10, total strain remains slightly in tension at the 620 second mark. FIG. 11 is a plot of an example of residual stresses after the spraying process has terminated. The high stress near the interface is due to the fact that bainite forms very quickly at that location and there is little austenite left to expansively transform for offsetting the thermal contraction at the end of the process. It should be noted that while there is a fine scale fluctuation in the temperature during the initial deposition process, collectively there is enough time above MS for a significant amount of bainite to form.

Figure 12:
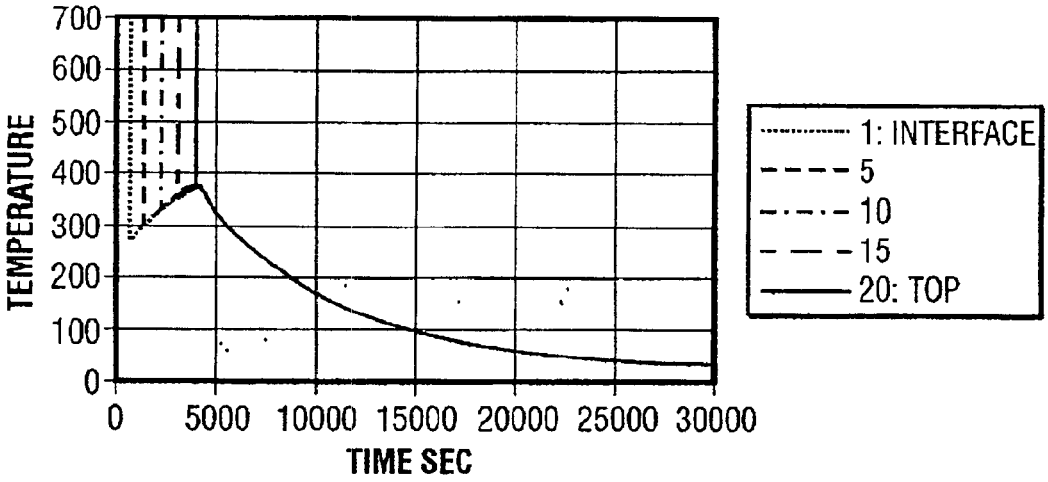
FIG. 12 shows a plot of temperature against time for a spray forming process using a steel with a MS temperature of about 400 C and an initial ceramic mold temperature of 250 C, which was generated using a one-dimensional model and which illustrates an example of what happens if the temperature is held well below the MS temperature.
Figure 13:
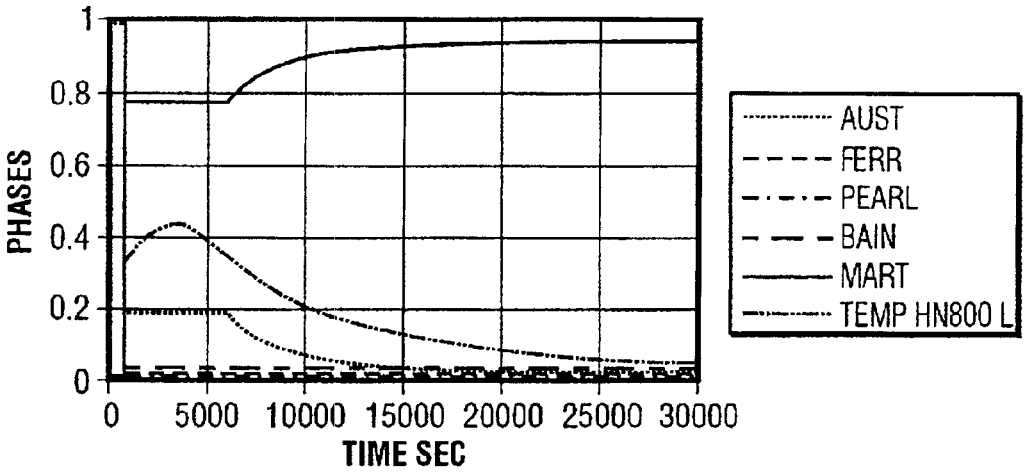
FIGS. 13 and 14 are plots which show how phases change with time in the spray forming process of FIG. 12.
Figure 14:
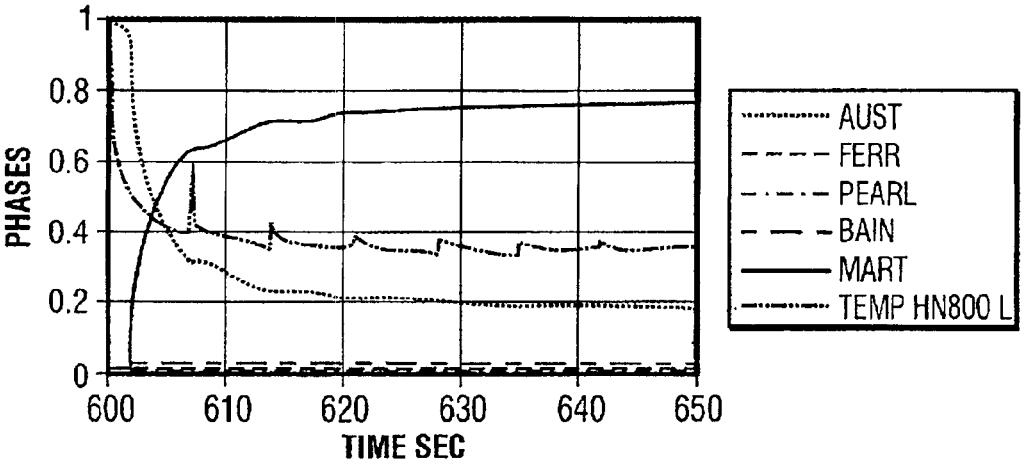
Figure 15:
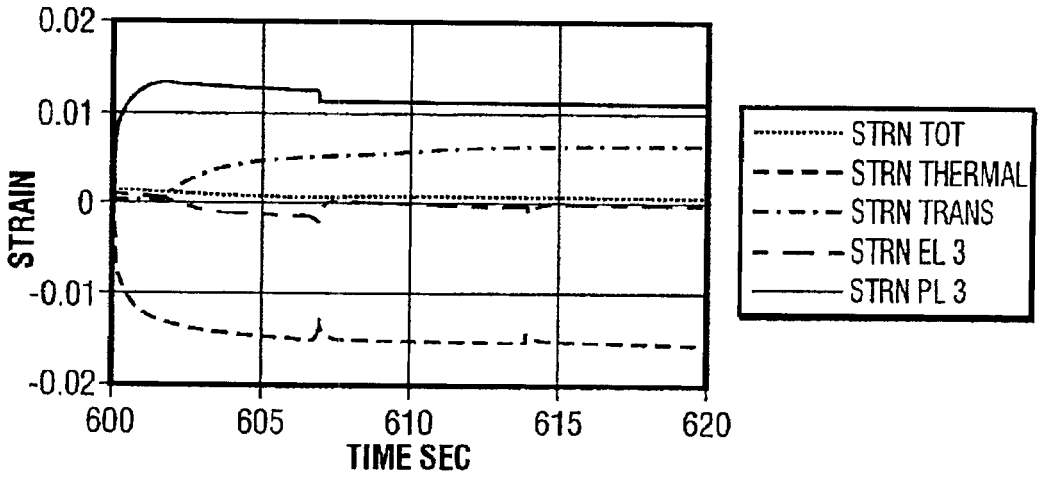
FIG. 15 is a plot which shows how strains develop with time in the spray forming process of FIG. 12.
Figure 16:
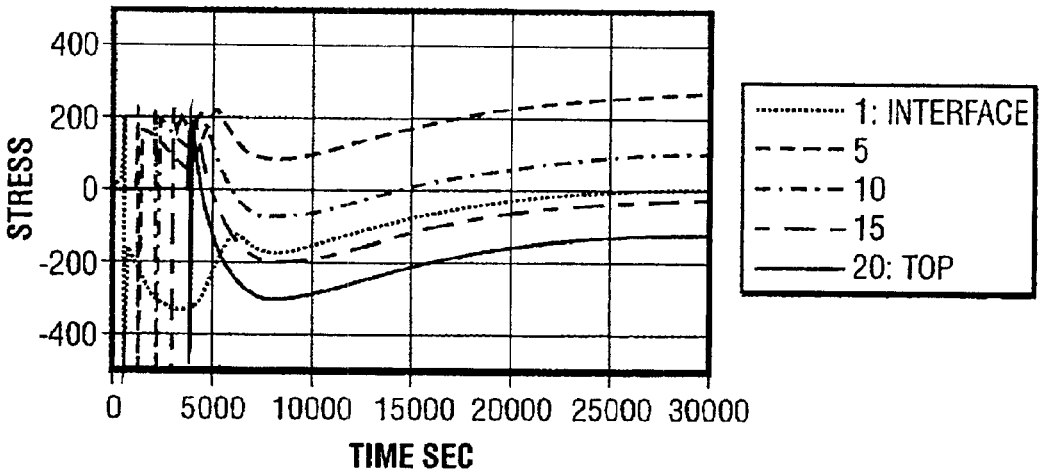
FIG. 16 is a plot which shows an example of residual stresses after the spray forming process of FIG. 12 is over.

FIGS. 12–16 show an example of what happens if the sprayed metallic material is held well below the MS temperature. For FIGS. 12–16, the steel is 0.2% carbon, the initial temperature of the ceramic model is 250 degrees C., and the MS temperature is about 400 degrees C. The plot of FIG. 12 shows information for five positions (at five cycle iterations) within the spray formed article. The first position is near the interface with the ceramic, and the fifth position is near the free surface (top) of the spray form. The plot of FIGS. 13 and 14 show an example of how the phases change with time. The plot shows austenite, pearlite, ferrite, bainite and martensite. A position near the interface was chosen to illustrate the idea. Note that a large amount of martensite forms almost instantaneously. The plot of FIG. 15 shows an example of how the strains develop with time. The key here is that a large proportion of martensite formed almost instantaneously, so there is nothing left for expansive transformation to offset the thermal strain during the final cool down. The plot of FIG. 16 shows an example of residual stresses after the process is over the sprayed article's interface with the ceramic model, the stress is substantially zero after 30,000 seconds. In the lower levels near the ceramic model, the article is in tension while near the top it is in compression.

An important aspect of the present invention is controlling when transformations occurs. Initially during spraying, the sprayed article is in a state of compression within itself, because it is contracting or shrinking. While it is in a state of tension with respect to the ceramic mold, it is in a state of compression within the article itself. In other words, as a droplet of sprayed steel falls on a particular spot on the mold which is at a lower temperature, the steel tends to shrink and pull together, so it is in tension with respect to the mold. However, the steel droplet is in a compressive state of stress within itself. For example, when steel is heated, it tends to expand, and when it is cooled, it tends to shrink. While the MS temperature is a function of the carbon content of the steel, the MS temperature is also affected by stresses. Therefore, when the steel experiences compressive stress locally, the MS temperature is reduced by small finite amounts which inhibits martensite transformation. Conversely, deviatoric stresses (like the kind of shearing force that smears out an initially vertical stack of playing cards) cause the MS temperature to increase.

An aspect of the present invention makes use of the character of bainite, which plays an important role in addition to martensite in offsetting stresses, because bainite is tougher and can absorb more stresses because of its ability to plastically and elastically deform. Another aspect of the present invention makes use of the timing of the phase transformation or when the transformation occurs. If the phase transformation occurs all at the beginning of the spraying process, there is nothing left to offset the stresses. A further important aspect of the present invention makes use of plasticity. It has been wrongly presumed in the past that plasticity is not important, because the finished spray formed articles behaves very elastically, does not have a great deal of plasticity in it per se, and in some cases, is almost brittle. The plasticity that is important in this aspect of the present invention is, however, plasticity within a local area, and typically between differently phased materials. For example, in a cooling spray formed body with martensite grains forming within the softer austenite phased sprayed material, plasticity is occurring at a local level between the martensite grains and the austenite. As the brittle martensite grains are expansively forming, they slide across the more "viscous" surrounding austenite, and even the bainite, which undergoes plastic deformation thereby dissipating stress and strain from the body of the sprayed article.

While a steel tool that is brittle overall is good for many applications in compression, it does not hold up very well in tension. A benefit of having bainite phased metal in the final material of the tool is that the tool is resultingly more ductile and tougher. In the past, when tools were made based on the idea that the effect of thermal contraction of the material as it was cooled could be exactly offset by the effect of volumetric expansion of martensite to achieve zero stress and strain. If the process took the austenite directly to the martensite transformation, the martensite's expansion and thermal contraction must exactly equal one another to achieve a zero strain result. However, the inclusion of bainite according to the present invention gives a little leeway, because of the ductility and toughness of bainite.

Figure 1:
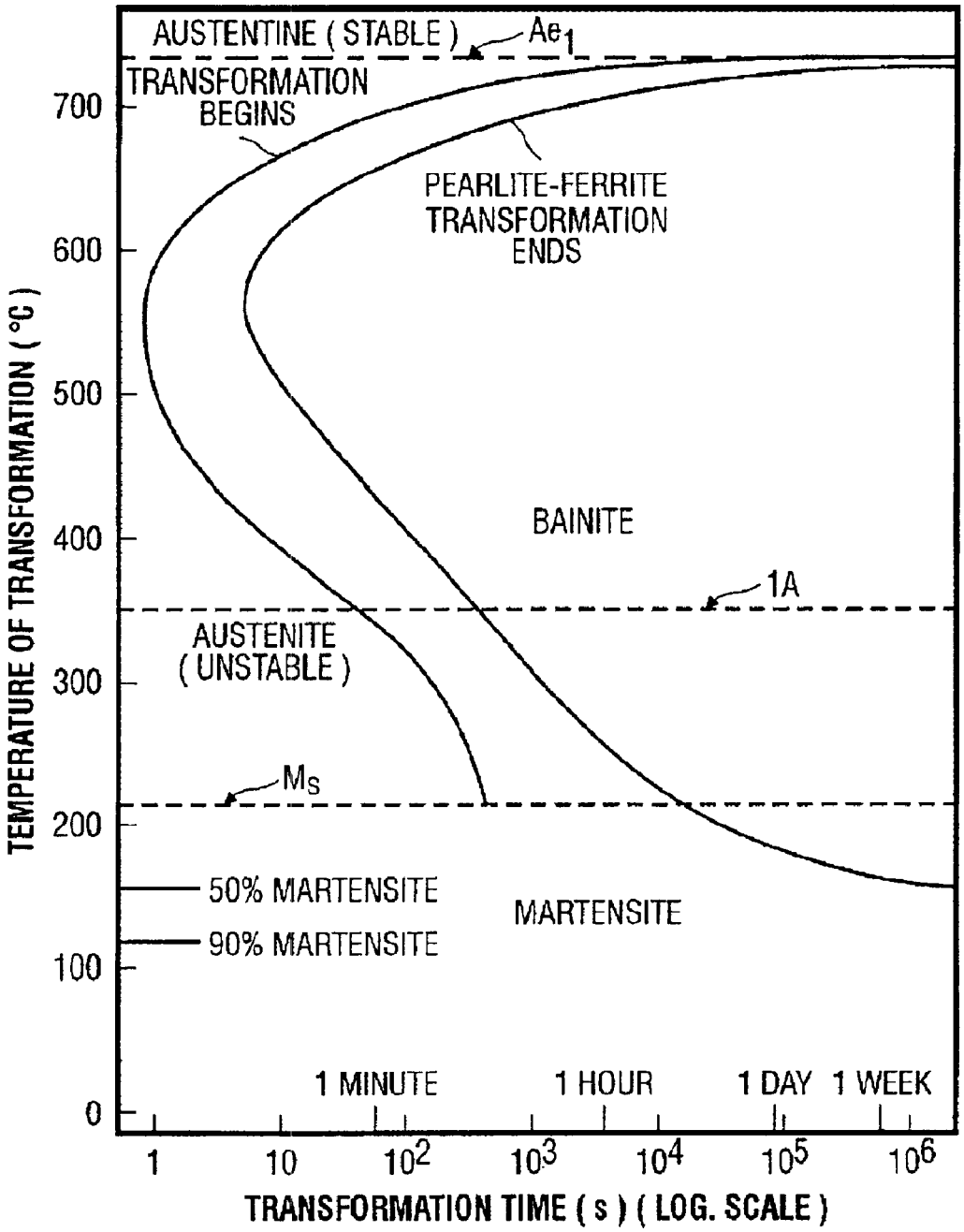
FIG. 1 is an example of a typical time-temperature-transformation (TTT) graph for steel of a type used in the spay forming process for an embodiment of the present invention.

A further aspect of the present invention involves measuring the temperature and adjusting the spray forming process accordingly, which can be accomplished in a number of ways. Referring to FIG. 1, one approach is to start out below the MS temperature and come up into the bainite transformation region. That approach is possible because martensite is temperature and not time dependent, so no additional martensite is formed with the passage of time if the temperature is held constant. Another approach is to go in the other direction through the bainite transformation region on the way down to the martensite transformation region so that transformation occurs during the spraying process. It must be remembered that the time scale is logarithmic, so regions toward the right side of the TTT curve represent the passage of far more time than regions toward the left side of the TTT curve. Therefore, it is possible to stay in the bainite transformation region, for example, for a predetermined period of time and transform a portion of the austenite to bainite and thereafter bring the temperature back down and transform the remaining austenite to martensite. Of course, once austenite transforms to bainite, it cannot transform to martensite, and that is the reason the plots always start out with one for austenite, followed by the fractions of the other phases, and the other phases add up to one after all the austenite is transformed.

Another aspect of the present invention makes use of the inducible plasticity associated with when the transformation occurs. Simply cooling the austenite phase does not result in stress control. The plot illustrates that if all of the austenite is transformed to martensite immediately as spraying is performed, stress control does not occur. While it is well known that austenite also transforms to the other phases such as pearlite, ferrite and bainite, a key aspect of the present invention is how the transformations are controlled and the characteristics such as plasticity that are observed in the control process. There is also a non-homogeneous stress distribution that is important to consider. Since the temperature of the ceramic mold may be initially below the MS temperature, the first few spray droplets at the interface with the mold may typically have at least some martensite formed. Thereafter, the temperature rises as later droplets are sprayed, and as time passes and the temperature rises above the MS temperature, the austenite that has not transformed to martensite can transform to bainite. Thus, it is also the commingled distribution of the bainite that is important, as it is advantageous to have bainite distributed throughout the article particularly during the spray process, and immediately thereafter to achieve the buffering effect that comes from the plastic deformation capabilities of the austenite and bainite.

Controllable variables or characteristics in the spray process include, for example, raising or lowering the voltage setting in the spray guns to increase or decrease the spray temperature, increasing or decreasing the rastering speed of the spray guns, changing the size of the spray guns, raising or lowering the temperature of the substrate, or changing the distance between the spray guns and the substrate to change the temperature on the spray form. In the past, it was known that changing certain of the variables by trial and error could cause stress control, but it was not known what combination of variables and their values were required to achieve stress control or why. The present invention provides a method for controlling certain variables and characteristics of the spray process to achieve stress control and to cause the phase transformations to occur in a predefined way that is beneficial to the finished article. For example, spray form operators typically spray different materials, such as steels with different carbon contents that cause the TTT curve to shift. Although the shape of the basic TTT curves are similar, the operator must handle different conditions for steels of different carbon contents. Thus, an operator who has learned through trial and error how to get stress control using 0.8% carbon steel runs into difficulty when called upon to spray 0.7% carbon steel, for which the TTT curve is shifted slightly. In the past it was not possible to instruct the operator what to do in that situation. However, according to an embodiment of the present invention, once the TTT curve for the new material is known, the combination of variables needed to achieve stress control for the particular material can also be known.

In one aspect of the present invention, a unique spray form cell is disclosed that is adapted to include heating capacity for the interior of the cell, as well as filtering, circulation and recirculation capabilities for the air contained within the confines of the cell's enclosed space. As shown in FIG. 2, an air handling arrangement may be exemplarily included atop the enclosure 10 defining the spray form cell. An air intake is shown at the right side of the cell, while a return duct is shown at the left side of the cell's interior ceiling. A fan is provided for forcing air circulation through the duct work which can selectively exhaust air pulled from the cell by permitting it to be directed upwardly as indicated by the outlined arrows in FIG. 2 utilizing an air directing means such as a flue, damper or other suitable arrangement. Alternatively, and as also shown in the drawing, a variably positionable damper can be advantageously positioned to the right of the first juncture in the circulation duct work above the fan. As indicated by the blackened arrows, this damper can also be configured to direct the air taken in from the spray cell into the horizontally oriented recirculation branch of the duct work.

A conditioning component is shown schematically as being located approximately at a mid-position along the length of this horizontal recirculation branch of the recirculation arrangement. This conditioning component may carry out a variety of functions, but in at least one embodiment of the invention, the conditioning component at least partly serves as a heater of the air being circulated in association with the spray form cell. Preferably, the heater is regulatable with respect to the intensity of the heat that it imparts to the air passing thereby, or alternatively the heat application cycle can be regulated. The heater may advantageously be thermostatically controlled from the monitoring and control room for the spray form process which is shown at the left of the spray cell; with the ultimate control temperature being sensed from the interior of the spray cell and correlated to thermostatic control from the control center.

The conditioning component or unit may also take the form of a filter for removing particulate from the circulated air. These conditioning aspects can be included in a single unit or in a series of several units, each having one or more functional purposes. In either case, filtering will advantageously take place in an upstream phase of the conditioning processes so that the air being heated and/or otherwise conditioned is essentially clean and non-contaminating to these downstream components.

As shown, the recirculation arrangement also includes a substantially horizontal recycle branch located immediately atop the spray cell and which can recycle, in whole or in part, the conditioned air after the horizontal recirculation branch, but before redistribution into the cell. This type of configuration may be utilized when more intensely heated air is desired to be distributed to the cell, or volumetrically reduced circulation is desired for the cell.

While simple distribution ducts are shown, it is also contemplated that the air may be specifically directed within the cell. For example, a direct application hose and nozzle may be employed which allows the heated air to be applied at certain more focused locations within the cell. An example is the application of the heated air more directly upon the ceramic model which may require substantial heat input, especially when being accomplished by air circulation upon an exterior surface thereof, to be raised to the desired temperature. It is also contemplated that the model may be heated interiorly. As an example, heating elements may be housed within the body of the ceramic model upon which the moltenized metal is deposited during the spray form process.

It should be appreciated that the recirculation arrangement of the present invention is primarily considered in the context of heating the spray cell, but cooling of the air being circulated through the duct work may also be employed. The primary goal of the conditioning arrangement is to control the environmental temperature of the enclosed cell whether that be to add or remove heat. An advantageous, but not exclusive way is by conditioning circulated air as exemplarily disclosed. Other suitable methods and arrangements may be employed to affect the conditioning of the internal space of a spray form cell and still perform according to the teachings of the inventions disclosed herein.

A further aspect of the present invention involves manipulating the temperature of the article being spray formed in such ways as to bring all areas of the sprayed article to a uniform temperature to enable cooling at a more nearly uniform rate and to avoid, for example, different phase changes occurring in different parts of the article at different times if that is a desired affect. This aspect involves the utilization of, for example, heat treatment processes that assure that the metal micro-structure, prior to cooling, has the proper phasing, so that when cooled, the thermal and solidification shrinkage is counteracted. This technique is an important tool that enables the "scaling up" of conventional spray forming processes for utilization in manufacturing much larger spray formed articles, for instance, on the order of eight feet by eight feet. These heat processes may be advantageously accomplished through the exemplary air conditioning and recycling arrangement disclosed herein.

Implementation of the pre-heat treatment aspect of the present invention before the spray forming begins involves, for example, preheating either or both of the spray forming cell environment and the mold substrate to a preselected initial temperature and initiating application of the metallic spray forming material at a preselected initial application temperature of the spray forming material onto the mold substrate. The spray forming cell environment includes, for example, the interior of the spray forming cell, which can be heated at least in part by heated air previously exhausted from the spray forming cell and filtered and recirculated back into the spray forming cell. This heating may in part or entirely be affected by any suitable means, such as electric or gas heating furnaces. The initial application temperature of the spray forming material is typically such that the metallic spray forming material is initially in an austenite phase of the spray forming material. In this aspect, preselected substantially homogenous initial metallic phase transformations from the austenite phase are caused to occur at least in part via a predetermined relationship between the initial application temperature of the spray forming material and the initial temperature of either or both of the preheated cell environment and the preheated mold substrate. Such initial phase transformations result in a substantially homogenous initial distribution of commingled metallic phases consisting of a predetermined proportion of either or both of bainite and martensite, in addition to a predetermined proportion of austenite. The initial distribution of commingled metallic phases can also include a predetermined proportion of a pearlite-ferrite phase of the spray forming material. Associated at least in part with these initial phase transformations are substantially homogenous initial volumetric changes that also occur in the spray forming material.

In order to achieve the preselected substantially homogenous initial phase transformations, either or both of the spray forming cell environment and the mold substrate can be preheated to an initial temperature different or similar to the initial application temperature of the spray forming material. When heated to a similar temperature any stress-inducing initial temperature differences at the interface with the mold substrate and the exposed surface of the tool being spray formed are eliminated or minimized, and a controlled initial proportion of the austenite phase can be transformed to either or both of initial proportions of bainite and pearlite-ferrite phases, without any initial transformation to martensite. Alternatively, either or both of the spray forming cell environment and mold substrate can be preheated to an initial temperature that is less than the initial application temperature of the spray forming material but slightly more than the martensite start temperature. In that case, initial temperature differences at the interface with the mold substrate and the exposed surface of the tool being spray formed are still minimized, and a controlled initial proportion of the austenite phase can be transformed to either or both of initial proportions of bainite and pearlite-ferrite phases, but transformation of the remaining austenite to martensite can be caused by only a slight further temperature reduction.

In another alternative, either or both of the spray forming cell environment and the mold substrate can be preheated to an initial temperature that is less than the initial application temperature of the spray forming material and slightly less than the martensite start temperature. In that situation, the initial temperature differences at the interface with the mold substrate and/or at the exposed surface of the tool being spray formed are somewhat minimized, and a controlled initial proportion of the austenite can be transformed to the martensite phase, for example, before raising the temperature slightly to cause transformation of the remaining austenite to bainite and/or pearlite/ferrite.

Implementation of the heat treatment aspect of the present invention during spray forming involves, for example, applying the metallic spray forming material at a pre-selected application temperature onto the mold substrate at a pre-selected substrate temperature in the spray forming cell environment at a pre-selected spray forming cell environment temperature. Pre-selected substantially homogenous metallic phase transformations of the spray forming material from the austenite phase are caused to occur at least in part via manipulation of one or both of the substrate temperature and the spray forming cell environment temperature. Such phase transformations result in a substantially homogenous distribution of commingled metallic phases consisting of a predetermined proportion of one or more of bainite, pearlite-ferrite, and martensite. The homogenous distribution of commingled metallic phases can also include a predetermined proportion of the austenite phase of the spray forming material. Likewise, there are associated at least in part with these phase transformations substantially homogenous volumetric changes in the spray forming material.

In order to achieve the pre-selected substantially homogenous initial phase transformations, either or both of the mold substrate temperature and the spray forming cell environment temperature are manipulated, for example, by maintaining either or both temperatures at the pre-selected temperature that is about the same or slightly less than the application temperature for a predetermined time interval thereby, at least in part, eliminating or minimizing temperature gradients. In this way, the temperature differences at the interface with the mold substrate and the surface of the tool being spray formed are eliminated or minimized and a controlled proportion of the austenite phase can be transformed to bainite and/or pearlite-ferrite rather than to martensite. Thereafter, the temperature of either or both can be lowered stepwise to a second pre-selected temperature that is below the application temperature, but higher than the martensite temperature, and maintained at the second temperature for a second predetermined time interval before lowering either or both temperatures to a third pre-selected temperature that is lower than the martensite start temperature. Thus, the temperature differences at the interface with the mold substrate and/or at the surface of the tool being spray formed are minimized, and controlled additional proportions of the austenite phase can be transformed to the bainite and/or pearlite phases, as well as martensite. Alternatively, the temperature of either or both can be lowered directly to the second pre-selected temperature that is below the application temperature and slightly below the martensite temperature, whereby the temperature differences at the interface with the mold substrate and at the surface of the tool being spray formed are somewhat minimized, and any remaining austenite can be transformed to martensite.

Implementation of the post heat treatment aspect of the present invention after spray forming is ended involves, for example, providing a spray formed metallic tool by applying spray forming material at a pre-selected application temperature onto the mold substrate with a pre-selected post-forming mold substrate temperature within the spray forming cell environment having a pre-selected post-forming spray forming cell environment temperature. Instead of utilizing the spray cell itself for the post treatment, another room or oven may be utilized. Pre-selected substantially homogenous metallic phase transformations of any remaining austenite within the spray formed tool to a substantially homogenous distribution of commingled metallic phases consisting of predetermined proportions of either or both of bainite and martensite are caused at least in part by manipulating either or both of the substrate temperature and the spray forming cell environment temperature. Associated with these transformations are substantially homogenous volumetric changes in the spray forming material within the spray formed tool. The manipulation of either or both of the temperatures include, for example, maintaining either or both of the substrate temperature and the cell environment temperature at the pre-selected post-forming temperature slightly above the martensite start temperature for a predetermined time interval and thereafter decreasing the temperature of either or both to a second pre-selected post-forming temperature slightly below the martensite start temperature. Thus, the temperature differences at the interface with the mold substrate and the surface of the tool being spray formed are minimized and controlled proportions of any remaining austenite can be transformed to the bainite and/or pearlite phases, and/or the balance of the austenite can be transformed to martensite.

Figure 19:
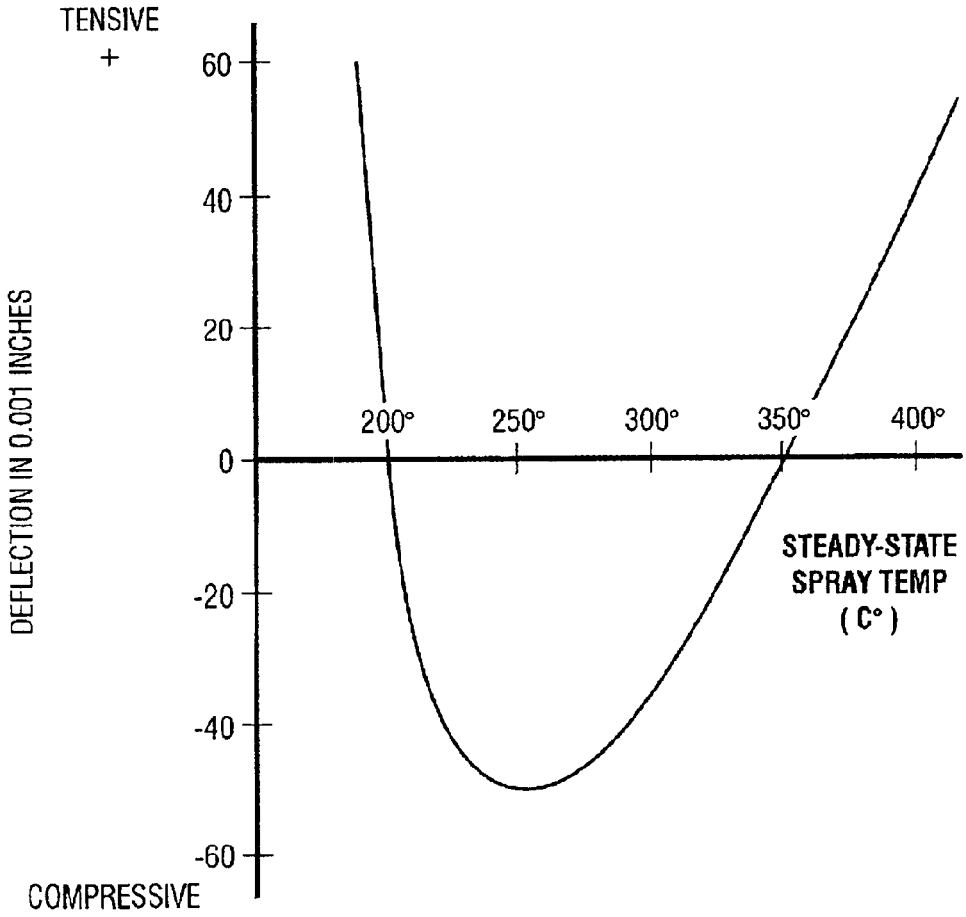
FIG. 19 is a graphical illustration of warpage (y-axis) experienced by a metallic plate of particular composition based on variable steady-state spray temperatures (x-axis). Positive warpage is shown to induce tensile stresses, while negative warpage produces compressive stresses.

FIG. 19 illustrates the warpage characteristic of a sprayed metal plate of a certain composition. The graph demonstrates that at two steady state spraying temperatures the resulting metal plates will experience essentially zero warpage. In the illustration of FIG. 19, that occurs at the lower steady state spraying temperature of 200 C and at the upper steady state spraying temperature of 350 C. Of less importance is the magnitude of the temperatures; what is more important is the slope of the behavior line as it approaches each temperature. The line is much steeper about the lower temperature, but more casual about the higher temperature. This illustrates that the condition or goal of zero warpage or deflection in such a sprayed article is most easily affected at the higher steady state spraying temperature because the temperature can fluctuate slightly without substantial departures in flatness.

Figure 17:
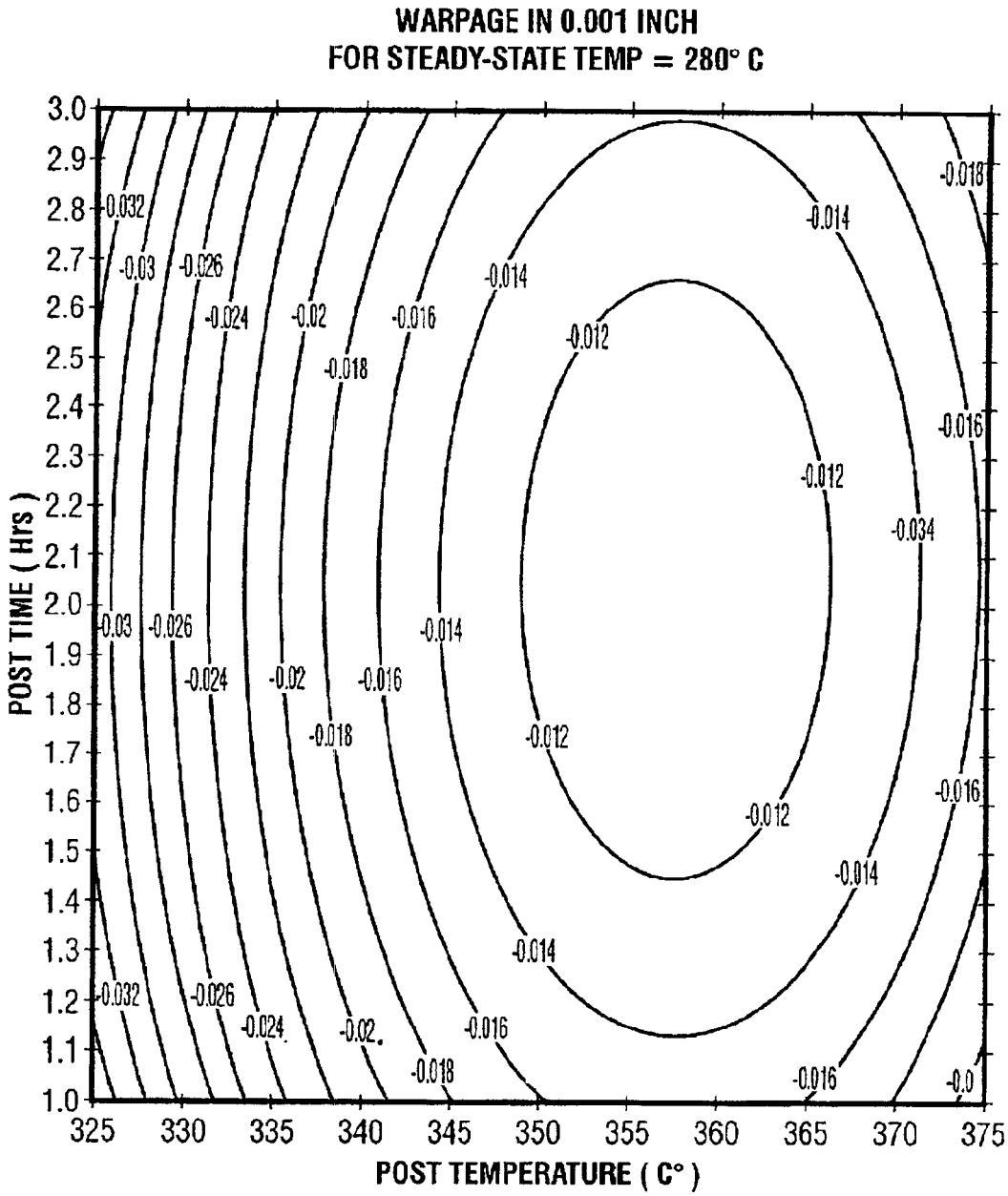
FIG. 17 is a topographical-style plot of warpage of a metallic plate sprayed at a steady-state temperature of 280 C considering a x-variable of temperature and a y-variable of time after completion of the spray process.
Figure 18:
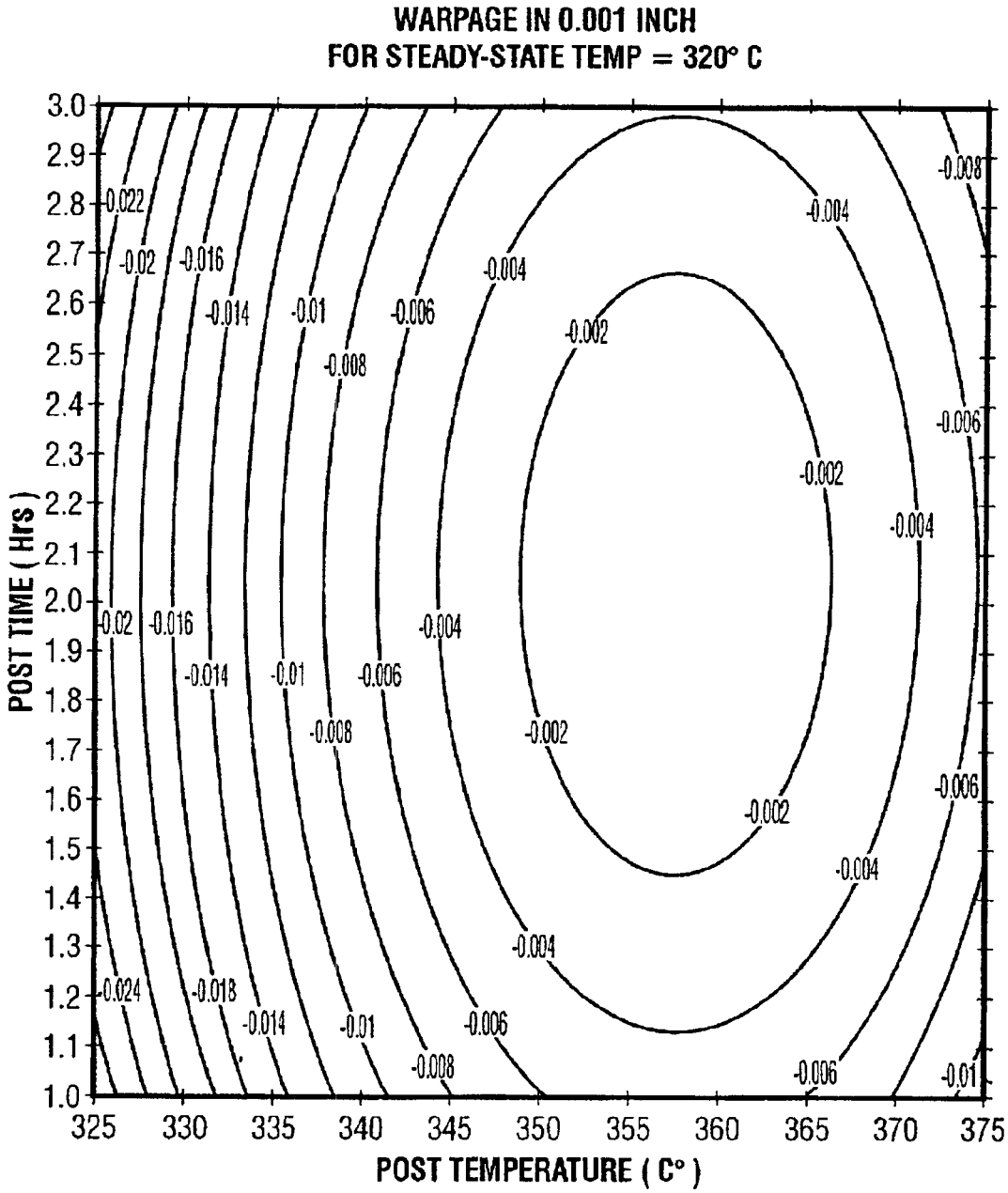
FIG. 18 is a topographical-style plot of warpage of a metallic plate sprayed at a steady-state temperature of 320 C when considering a x-variable of temperature and a y-variable of time after completion of the spray process.

FIGS. 17 and 18 each show topographical-style representations of empirical measurements of deflection in a metal plate sprayed at 280 C and 320 C, respectively. Different magnitude post-temperature treatments are indicated on the x-axis against increasing after-spray durations of post heat treatment on the y-axis. Immediately, it is evident that for the metal composition used in this example, the 320 C steady state sprayed sample experienced less deflection overall. But even more interesting, each Figure indicates a "sweet spot" or bulls-eye representing a minimized deflection zone that encompasses a range of post temperatures and durations held at those temperatures. Using these and similar empirical and analytical plots, the best conditions for a post heat treatment process are determined. From these graphs, the most efficient conditions are determined that will deliver the requisite qualities demanded by the end use of the article being spray formed. Optimized post heat treat conditions are ascertained and then applied to mass production spray form processes for manufacturing minimum deflection articles. Now that the surprising beneficial aspects of select post heat treat conditions have been appreciated, different scenarios can be modeled without taking empirical data and the prescribed conditions imposed on an appropriate spray form manufacturing process to produce articles having the desired end-use characteristics.

An additional aspect of the present invention involves the use of a one dimensional simulation to control the spray guns. The one dimensional calculation allows an understanding of where the stresses are and how to control the spray process. The curves on the plots, on which the "substrate" refers to the surface to which the spraying is applied, were made using the one dimensional simulation. The one dimensional plot is much quicker to perform than a two or three dimensional plot because the code for the one dimensional plot is more simple than the complex code required for two or three dimensional plots. Because the one dimensional simulation is based on a number of assumptions, such as boundary conditions and how heat transfer occurs across an article being sprayed, two and three dimensional plots can be used to confirm that the one dimensional simulation is accurate. Once it is confirmed that the one dimensional simulation is a good representation, the one dimensional simulation can be run very quickly. Since it can be performed almost instantly, the one dimensional simulation can be integrated with the robot controls for the spray process for real-time control purposes.

Temperature drives the spray process and must be known. It enables a determination of when the phase transformations occur, which is related to the stresses. In addition, the transformation from austenite to martensite gives off latent heat which affects the temperature of the part locally. Once the temperature is known, various calculations can be made to determine, for example, the kinds of stresses that are occurring. If the material is in a highly compressive state, which is undesirable, a loop can be provided in the code that adjusts the robotic controls of the spray process. For example, if the spray guns are applying too much or too little heat on a particular area, the heat energy input can be decreased or increased or the spray guns can be redirected to another area. It is not sufficient to simply monitor the temperature. Monitoring the temperature tells how hot the spray form article is, but it does not reveal what the stresses or the resulting distortions are. The occurrence of residual stresses in the spray form article, such as a tool, is what causes the distortions and resulting misshaping of the tool.

There is no residual stress if two stresses or strains offset one another, but if there is a residual stress or strain remaining when the part is removed, deformation is possible. The one dimensional simulation afforded by one aspect of the present invention provides a way to minimize residual strain.

The one dimensional simulation essentially treats a point that is analyzed with respect to depth of the article without considering what is occurring around it. Thus, from a temperature gradient taken along a line straight down into the article, the one dimensional simulation provided by one embodiment of the present invention makes it is possible to calculate stresses for the particular point and build up a simulation of what is occurring in the spray process. The history of the process can be taken and the stresses calculated using the one dimensional approach. The one dimensional simulation enables the phases to be known and whether the phases are what are considered to be ideal. If the phases that are known to cause the desired stresses are not present, the robotic spray gun controls can be adjusted, for example, to increase or decrease the heat energy that is applied. In the described embodiment, the parameter that is actually read is the surface temperature of the last-sprayed layer of the article as it increases in thickness. The temperature is sensed and fed into the one dimensional modeling program. In the sense that temperature drives what phases are known to be present in the sprayed material, temperature is the driver for the calculations and predictions about other conditions that can be calculated and modeled using the one dimensional simulation.

In the past, if an operator observed that a spray formed article, such as a tool, was substantially free from stress induced dimensional distortion, i.e. warping, when removed from the substrate, the operator deemed the particular procedure used in spray forming the tool to be a success. Of course, that did not necessarily mean that the tool was stress free, which the operator had no way of knowing, but only that it was free of stress that was substantial enough to cause observable dimensional distortion or warping. On the other hand, the one dimensional simulation of the present invention focuses on controlling residual stresses by determining and controlling stresses locally within the microstructure of the spray formed article. This stress control is accomplished, for example, by integrating the one dimensional simulation with the spray gun controls.

Attempts were made in the past to control the stress by focusing on controlling the temperature on the surface of the article being spray formed on the assumption that residual stresses could be eliminated by simply maintaining a uniform temperature across the surface of the spray formed article. However, that assumption was oversimplified in that there are numerous timing issues associated, for example, with the plasticity and the phase transformations in the spray form process. The one dimensional model or line simulator of the present invention offers a far better solution by considering that what is actually sought to be controlled during the spray process is the stresses within the article and predicting and controlling those stresses.

The one dimensional simulation of the present invention utilizes the depth dimension on the assumption that the heat flows straight downward instead of laterally out to the sides. It is assumed that beneath the footprint of the spray guns, the spray guns deposit the sprayed material and energy in the form of heat is conducted straight downward toward the ceramic substrate or is radiated off only straight upwardly. Based on that assumption, the one dimensional model predicts what the phase transitions are and what the residual stress is in the sprayed material at the point at a certain depth. According to the one dimensional simulation, aspects, such as the thermal conductivity, are modeled so that the temperature is known at a given depth. It is not assumed that the temperature is uniform through the depth, and simulations illustrate that there is a substantial temperature gradient as a function of depth. Moreover, even if the temperature were uniform across the depth, the fact that the spray form material has been deposited at different times as spraying proceeds means that the process is in different stages at different depths. Thus, even if the temperature were uniform through the depth, that would be no guarantee of zero residual stress, because the material at different depths has experienced different thermal histories.

The one dimensional simulation of the present invention enables controlling the spray guns in a very sophisticated feed-forward way to vary and control the temperature through the depth of the sprayed material. The temperature history of an article being spray formed is known up to a current point in time, and the one dimensional simulation enables a determination to be made of how the spray process should proceed from the current point in time in order to achieve reduced residual stress. For example, based on the knowledge that a particular tool is to have a particular thickness and will take a certain amount of time to spray, the one dimensional simulation enables a determination to be made of what must be done at the current time to control the spray process in order to guarantee a minimized residual stress, and then execute such control.

As a practical matter, the determination of what must be done to control the spray process is typically made for only a limited number of passes of the spray guns, such as one hundred passes. Thereafter, the one dimensional line simulator is then solved again with knowledge of the history, and the robotic controls for the spray guns are modified accordingly. The surface temperature is taken continuously during the entire spray process, so a complete temperature history is available, but in practice, it is slow and inefficient to reprogram the spray guns for every pass because of the high rate of speed at which the performance of the spray guns move. Thus, while the spray guns could be modified as often as desired, it is considered more practical to adjust the spray guns after a predetermined number of passes. Nevertheless, the temperature is read continuously for each of the predetermined number of passes, so a history is available for the interim passes.

Figure 1A:
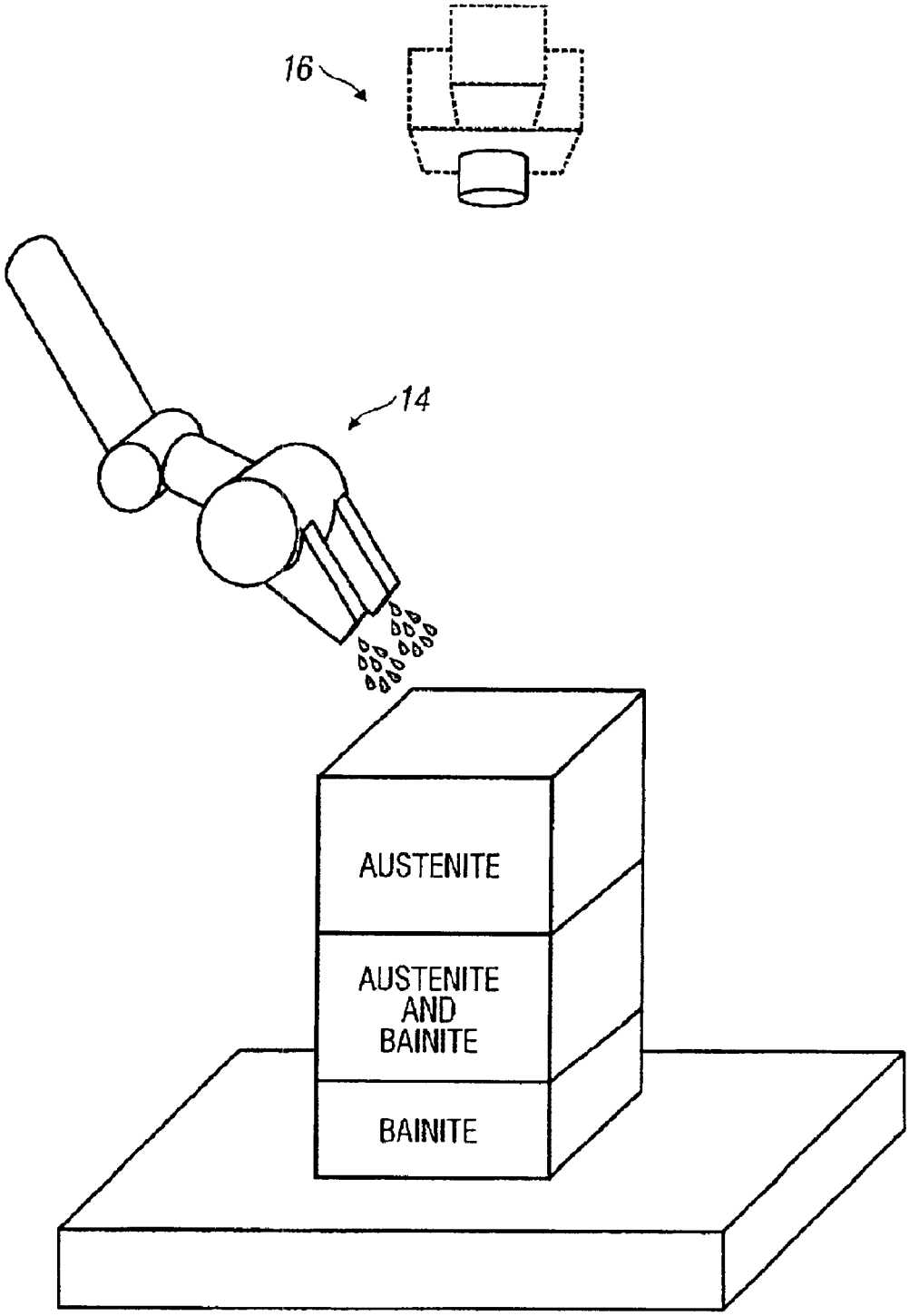
FIG. 1A is a representation of either an actual or modeled sample column taken from a larger metallic spray formed article.

The one dimensional simulation of the present invention makes use of a representative column, as illustrated in FIG. 1A which is called out in FIG. 1 at approximately 350 C, that has been taken as a straight-through-section from the top of the most recent spray form deposit down to the interface with the ceramic mold. Therefore, it is advantageous to pick several representative points on the surface of the spray form and solve the one dimensional line simulator for each representative point. Rather than attempting to solve the line simulator for points continuously across the surface of the spray form deposit, which is impractical, it is done at several key points across the surface. It has been found that if the residual stress can be made zero at a number of representative points, it is almost certain that the residual stress will approach zero everywhere. If the article being spray formed has, for example, irregular surface details, the representative points can be selected strategically to accommodate the irregularities.

Using the historical temperature with respect to each representative point, the one dimensional simulation of the present invention makes it possible to predict the phases and strains that are occurring on a vertical section. Since the thermal conductivity of the sprayed material and the substrate are known, it is possible to predict the temperature downward as well as upward along the vertical line. Assume, for example, that in the first layer of the spray form deposit, the temperature was 200 C and that the spray form has built up to the $500^{th}$ layer and is now 300 C. In the one dimensional simulation, the heat equation is solved at every incident time by assuming that the important occurrences are taking place straight up and down.

An analogy can be made between the vertical section used in the one dimensional simulation of the present invention and a straightened coat hanger wire standing vertically upright. If heat is applied at the top of the coat hanger, for example, by passing the flame of a cigarette lighter back and forth, the temperature can be solved along the entire length of the coat hanger as a function of time. If the heat equation is solved on the coat hanger, the temperature can be known everywhere on the coat hanger as a function of time. Passing the cigarette lighter flame back and forth at the top of the coat hanger is analogous to passing the spray guns back and forth across the spray form. Using the one dimensional simulation, the temperature can be known, or at least predicted, everywhere on that vertical section of the spray form as a function of time, and from that, the thermal strains and how much of the phase transformations have occurred can also be known, or at least predicted.

The one dimensional line simulator equation of the present invention is relatively uncomplicated and can be executed very fast because it is focused in one dimension. The one dimensional simulation provides a highly sophisticated control system that enables control of the spray guns based on a knowledge of the microstructure and the residual stresses in the spray form material to minimize the deformation of the final tool. It also provides the ability to control, for example, with respect to moving between the bainite and martensite and to control, for example, with respect to temperature and time for the buffer effect. In addition, it addresses the inclusion of plasticity and the timing of where the transformation occurs. An important aspect of the one dimensional simulation is that it improves the spray forming process by enabling the controlled design of the microstructure. For example, bainite is tougher than martensite, so a buffer can be designed in and tuned with a combination of the very hard martensite with a somewhat softer but tougher bainite so that the spray formed tool has a longer service life and is not so brittle as to be susceptible to breakage.

An important aspect of the one dimensional simulation of the present invention addresses the issue of the spray forming of tools made of different materials. For example, assume that an end user wants a tool made of material that can withstand a corrosive environment that requires a specific alloy. Such a tool cannot be made simply of a carbon steel, but must have, for example, high chromium and nickel levels, more like a stainless steel. The one dimensional simulation eliminates the need for lengthy trial and error experiments by an operator spray forming samples of the tool with the new alloy as a result of shifts in the TTT curve. Rather, the one dimensional simulation makes it possible to actually design the spray forming process with the alloy content and resulting TTT curve shift in mind.

An additional aspect of the one dimensional simulation of the present invention is that it enables changing the final working properties of the spray formed part, such as the toughness and/or the hardness. Again, it is no longer necessary for an operator to perform countless spray forming trials attempting to learn how to make a distortion free spray formed part with particular working properties. Instead, the one dimensional simulation can be used to prescribe a spray process and then monitor it as it is implemented with necessary adjustments being made along the way. For example, it may be desirable to have a tool made with a small compressive residual stress to urge small cracks in the tool to close. Currently, there is no way to design a tool with that type of compressive stress retained therein regardless of whether it is spray formed or made another way; it is simply luck if it occurs. The one dimensional simulation provides a sufficient fidelity of the control process to actually design parts in which there is a compressive residual stress on the working surface of a tool, such as a stamp. That means the tool lasts much longer, because the cracks are under a compressive load that minimizes a tendency of the cracks to cycle open and shut and eventually rip apart during use of the tool.

In summary, the characterizations and anecdotal data contained herein demonstrate the utility and success of the presently disclosed inventions' advantageous integration of the time, temperature, and transformation dependent stress relief techniques into a thermal spray process. The spray form process can be advantageously used to create steel articles with complex surface topology by spraying molten steel onto a ceramic substrate representing the required surface structure. Such steel billets can be utilized as tools, particularly stamping tools, in the automotive, as well as other industries requiring metal-faced tools. Advantageously, these tools can be rapidly created using the spray form process. As a refinement of the spraying process, temperature control in the form of heat input to the spray environment can be advantageously employed before, during and after the actual spray deposit of the moltenized metal. From a control aspect, the one dimensional model that has been described can be utilized for predictive analysis, as well as feed-forward control of the spray process.

Various preferred embodiments of the invention have been described in fulfillment of the various objects of the invention. It should be recognized that these embodiments are merely illustrative of the principles of the invention. Numerous modifications and adaptations thereof will be readily apparent to those skilled in the art without departing from the spirit and scope of the present invention.

What is claimed is:

1. A method for implementing post-heat treatment after spray forming is ended to achieve stress control in the manufacture of a spray-formed metallic tool, comprising:

providing a spray-formed metallic tool formed by application of a spray-forming material at a preselected application temperature upon a mold substrate having a pre-selected post-forming mold substrate temperature disposed within a spray-forming cell environment having a pre-selected post-forming spray forming cell environment temperature;

causing preselected substantially homogenous metallic phase transformations of the spray forming material within the spray-formed metallic tool to a substantially homogenous distribution of commingled metallic phases consisting of predetermined proportions of at least a bainite phase and a martensite phase of the spray forming material; and wherein the substantially homogenous metallic phase transformations are caused at least in part via manipulation of at least one of the post-forming substrate temperature and the post-forming spray forming cell environment temperature.

2. The method of claim 1, wherein causing the metallic phase transformations further comprises causing substantially homogenous volumetric changes in the spray forming material within the spray-formed metallic tool associated at least in part with the metallic phase transformations of the spray forming material.

3. The method of claim 1, wherein the manipulation of at least one of the substrate temperature and the spray forming cell environment temperature further comprises maintaining at least one of the mold substrate and the spray forming cell environment at the pre-selected post-forming temperature greater than a martinsite start temperature for the spray forming material for a predetermined time interval and thereafter decreasing the temperature of the at least one of the mold substrate and the spray forming cell environment to a second pre-selected post-forming temperature below the martinsite start temperature.

4. The method of claim 3, wherein the manipulation of at least one of the substrate temperature and the spray forming cell environment temperature further comprises maintaining both the mold substrate and the spray forming cell environment at the pre-selected post-forming temperature greater than the martinsite start temperature for the spray forming material for the predetermined time interval and thereafter decreasing the temperature of both of the mold substrate and the spray forming cell environment to the second pre-selected post-forming temperature below the martinsite start temperature.

5. The method of claim 3, wherein the manipulation of at least one of the substrate temperature and the spray forming cell environment temperature further comprises maintaining the spray forming cell environment at the pre-selected post-forming temperature greater than the martinsite start temperature for the spray forming material for the predetermined time interval and thereafter decreasing the temperature of the spray forming cell environment to the second pre-selected post-forming temperature below the martinsite start temperature.

6. The method of claim 3, wherein the manipulation of at least one of the substrate temperature and the spray forming cell environment temperature further comprises maintaining the mold substrate at the pre-selected post-forming temperature greater than the martinsite start temperature for the spray forming material for the predetermined time interval and thereafter decreasing the temperature of the mold substrate to the second pre-selected post-forming temperature below the martinsite start temperature.

* * * * *